US008887696B2

(12) United States Patent
Shimura et al.

(10) Patent No.: US 8,887,696 B2
(45) Date of Patent: Nov. 18, 2014

(54) EVAPORATED FUEL HANDLING APPARATUS

(75) Inventors: Takeshi Shimura, Wako (JP); Ikuo Hara, Wako (JP); Tadaaki Nagata, Wako (JP); Shinji Kobayashi, Wako (JP); Takahiro Imamura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 390 days.

(21) Appl. No.: 13/439,255

(22) Filed: Apr. 4, 2012

(65) Prior Publication Data

US 2012/0255525 A1 Oct. 11, 2012

(30) Foreign Application Priority Data

Apr. 7, 2011 (JP) ..... 2011-085575

(51) Int. Cl.
*F02M 33/02* (2006.01)
*F02M 25/08* (2006.01)

(52) U.S. Cl.
CPC ..... *F02M 25/0836* (2013.01); *F02M 25/0872* (2013.01)
USPC ..... 123/519; 123/520

(58) Field of Classification Search
USPC ..... 123/516, 518–520; 220/210
See application file for complete search history.

(56) References Cited

U.S. PATENT DOCUMENTS 4,053,083 A * 10/1977 Hukuta ..... 220/202
4,312,649 A * 1/1982 Fujii et al. ..... 96/109
4,659,346 A * 4/1987 Uranishi et al. ..... 96/109
4,754,627 A * 7/1988 Butler, III ..... 70/158
4,984,698 A * 1/1991 Stuckey ..... 215/207
5,000,339 A * 3/1991 Wheat et al. ..... 220/203.07
5,904,057 A * 5/1999 Abney et al. ..... 70/167
6,092,685 A * 7/2000 Gruber ..... 220/86.2
6,223,923 B1 * 5/2001 Fishman ..... 220/210
7,267,112 B2 * 9/2007 Donahue et al. ..... 123/518
7,677,277 B2 * 3/2010 Thompson et al. ..... 141/350
8,100,297 B1 * 1/2012 Anish et al. ..... 222/153.03
2008/0092858 A1 * 4/2008 Satoh et al. ..... 123/520
2012/0240904 A1 * 9/2012 Shimura et al. ..... 123/519

FOREIGN PATENT DOCUMENTS

JP 2004-156496 A 6/2004

* cited by examiner

*Primary Examiner* — Thomas Moulis
*Assistant Examiner* — Joseph Dallo
(74) *Attorney, Agent, or Firm* — Westerman, Hattori, Daniels & Adrian, LLP

(57) ABSTRACT

A fuel cap includes a communication chamber configured to make a charge path and the inside of the fuel tank communicate with each other while in a closed state. The communication chamber includes: a positive pressure control valve configured to open, and send evaporated fuel, which occurs inside the fuel tank, to an evaporated fuel reservoir via the communication chamber and the charge path when the internal pressure of the fuel tank becomes equal to or greater than a predetermined pressure; and a negative pressure control valve configured to open, and send air from the evaporated fuel reservoir to the fuel tank via the communication chamber and the charge path when the internal pressure of the fuel tank becomes equal to or less than the predetermined pressure. In addition, a key cylinder sets the negative pressure control valve open upon inserting a key into the key cylinder.

8 Claims, 16 Drawing Sheets

EVAPORATED FUEL HANDLING APPARATUS

CROSS-REFERENCE TO RELATED APPLICATION

The present application claims the benefit of priority to Japanese Patent Application No. 2011-058875, filed on Apr. 7, 2011, the entire contents of which is incorporated by reference.

TECHNICAL FIELD

The present disclosure relates to an evaporated fuel handling apparatus for a vehicle which is configured to guide evaporated fuel, which has occurred inside a fuel tank, to the outside of the fuel tank.

BACKGROUND OF THE INVENTION

As an evaporated fuel handling apparatus for a vehicle including a hermetically-sealed fuel tank, Japanese Patent Application Publication No. 2004-156496 discloses a system for controlling the internal pressure of the fuel tank through electronic control in order to prevent evaporated fuel or fuel from flowing out of the tank via a fuel filler port while refueling the vehicle when the internal pressure of the fuel tank is high.

SUMMARY OF THE INVENTION

The system of Japanese Patent Application Publication No. 2004-156496 can be suitably used for relatively large four-wheeled vehicles and the like. However, it is difficult to apply the system to motorcycles and the like whose space is small, whose low price is supported, and whose fuel filler port is directly opened by being manipulated with a key.

The present disclosure has been made with the above-mentioned situation taken into consideration. An object of the present disclosure is to provide an evaporated fuel handling apparatus for a vehicle, which is configured to inhibit the outflow of the evaporated fuel into the atmosphere by use of its simple structure, and which can be suitably used for small vehicles.

As means for solving the above problems, an embodiment of the disclosure provides an evaporated fuel handling apparatus for a vehicle, including: a fuel tank (2) in which to reserve fuel; a fuel cap (4) attached to a fuel filler port (3) of the fuel tank (2), and configured to become capable of opening and closing the fuel filler port (3) by being manipulated with a key (49) to be inserted in a key cylinder (20); an evaporated fuel reservoir (6) in which to reserve evaporated fuel with adsorbent adsorbing the evaporated fuel; a charge path (5) making the fuel tank (2) and the evaporated fuel reservoir (6) communicate with each other; and a purge path (8) making the evaporated fuel reservoir (6) and an air intake system (7) of an internal combustion engine communicate with each other, characterized in that the fuel cap (4) includes a communication chamber (25) configured to make the charge path (5) and an inside of the fuel tank (2) communicate with each other, and the communication chamber (25) includes an on-off valve configured to open when an internal pressure of the fuel tank (2) becomes equal to a predetermined pressure, and thus to make the fuel tank (2) and the evaporated fuel reservoir (6) communicate with each other, and the on-off valve is set open by a linkage member (43, 61, 100, 200, 163) linked to the manipulation of the key (49), and thus sends the evaporated fuel in the fuel tank (2) to the evaporated fuel reservoir (6).

The evaporated fuel handling apparatus for a vehicle can further include a pressure piece (43, 61) is provided between the key cylinder (20) and the on-off valve, the pressure piece (43, 61) constituting the linkage member (43, 61) which is configured to set the on-off valve open in conjunction with an action of inserting the key (49) into the key cylinder (20) and pressing down the key cylinder (20).

The on-off valve can comprise: a positive pressure control valve (27) configured to open, and thus send the evaporated fuel, which occurs inside the fuel tank (2), to the evaporated fuel reservoir (6) via the communication chamber (25) and the charge path (5), when the internal pressure of the fuel tank (2) becomes equal to or greater than a predetermined pressure; and a negative pressure control valve (26) configured to open, and thus send air from the evaporated fuel reservoir (6) to the fuel tank (2) via the communication chamber (25) and the charge path (5), when the internal pressure of the fuel tank (2) becomes equal to or less than the predetermined pressure, and the pressure piece (43, 61) is provided to link with any one of the positive pressure control valve (27) and the negative pressure control valve (26).

The key cylinder (20) can be provided in a cylinder chamber (21) which is provided in or near a center of the fuel cap (4), the positive pressure control valve (27) and the negative pressure control valve (26) are arranged in parallel in a circumferential direction about the key cylinder (20), outside the key cylinder (20) in the fuel cap (4) in a radial direction, a through-hole is formed between the cylinder chamber (21) and the communication chamber (25) housing the negative pressure control valve (26), and the pressure piece (43) penetrates through the through-hole, and connects the key cylinder (20) and the negative pressure control valve (26) by means of a seal member.

A key manipulation waiting mechanism can be provided inside the communication chamber (25) including any one of the positive pressure control valve (27) and the negative pressure control valve (26), the key manipulation waiting mechanism being configured to detect a difference between pressures inside and outside the fuel tank (2), and to prohibit manipulation of the key (49) when the internal pressure of the fuel tank (2) is equal to or greater than a predetermined pressure.

The key cylinder (20) can be provided with the linkage member (100, 200, 163) configured to set the on-off valve open in conjunction with a manipulation of turning the key (49).

The on-off valve can comprise: a positive pressure control valve (27) configured to open, and thus send the evaporated fuel, which occurs inside the fuel tank (2), to the evaporated fuel reservoir (6) via the communication chamber (25) and the charge path (5), when the internal pressure of the fuel tank 2 becomes equal to or greater than the predetermined pressure; and a negative pressure control valve (26) configured to open, and thus send air from the evaporated fuel reservoir (6) to the fuel tank (2) via the communication chamber (25) and the charge path (5), when the internal pressure of the fuel tank (2) becomes equal to or less than the predetermined pressure, the key cylinder (20) is provided in a cylinder chamber (21) which is provided in or near the center of the fuel cap (4), the positive pressure control valve (27) and the negative pressure control valve (26) are arranged in parallel in a circumferential direction about the key cylinder (20), outside the key cylinder (20) in the fuel cap (4) in a radial direction, a through-hole is formed between the cylinder chamber (21) and the communication chamber (25) housing any one of the positive pressure control valve (27) and the negative pressure control valve (26), and a helical engagement groove (101) is formed in a side surface of the key cylinder (20), and the linkage member (100, 200) is engaged at one end with the engagement groove (101), penetrates through the though-hole, and is connected at an opposite end to any one of the positive pressure control valve (27) and the negative pressure control valve (26), and any one of the positive pressure control valve (27) and the negative pressure control valve (25) is set open in conjunction with upward and downward movement of the linkage member (100, 200), which is caused by turn of the key cylinder (20).

The on-off valve can comprise: a positive pressure control valve (161) configured to open, and thus send the evaporated fuel, which occurs inside the fuel tank (2), to the evaporated fuel reservoir (6) via the communication chamber (25) and the charge path (5), when the internal pressure of the fuel tank 2 becomes equal to or greater than the predetermined pressure; and a negative pressure control valve (26) configured to open, and thus send air from the evaporated fuel reservoir (6) to the fuel tank (2) via the communication chamber (25) and the charge path (5) when the internal pressure of the fuel tank (2) becomes equal to or less than the predetermined pressure, the key cylinder (20) is provided in a cylinder chamber (21) which is provided in or near the center of the fuel cap (4), the positive pressure control valve (161) and the negative pressure control valve (26) are arranged in parallel in a circumferential direction about the key cylinder (20), outside the key cylinder (20) in the fuel cap (4) in a radial direction, a through-hole is formed between the cylinder chamber (21) and the communication chamber (25) housing any one of the positive pressure control valve (161) and the negative pressure control valve (26), and the linkage member (163) is slidably provided in the through-hole; a cam (162), which turns in a circumferential direction of the key cylinder (20), is formed in the key cylinder (20); and any one of the positive pressure control valve (161) and the negative pressure control valve (26) is set open when the linkage member (163) comes into contact with the cam (162) and thus slides in conjunction with turn of the key cylinder (20).

The present disclosure makes it possible to prevent evaporated fuel from being discharged into the atmosphere due to the internal pressure of the fuel tank when the fuel cap is opened, because before the fuel cap is opened, the internal pressure of the fuel tank can be bled to the evaporated fuel reservoir by setting the on-off valve open in conjunction with the manipulation of the key cylinder by use of the key when the fuel filler port is opened. In addition, the present disclosure exhibits excellent convenience, and can be suitably applied to small vehicles, because the prevention of the discharge of the evaporated fuel into the atmosphere can be achieved by the simple structure exploiting the manipulation of the key cylinder by use of the key when refueling the vehicles.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
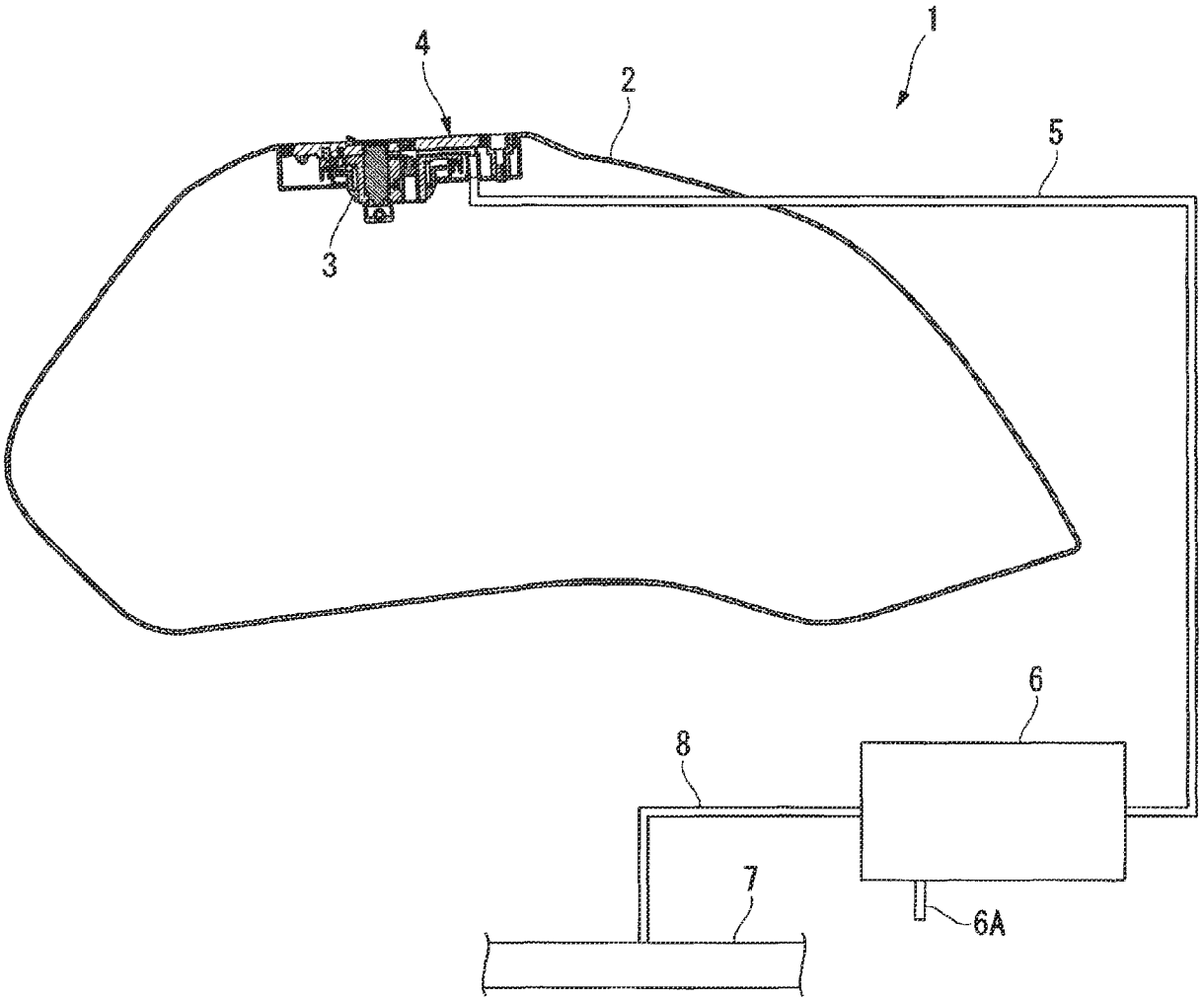
FIG. 1 is a diagram schematically showing a configuration of an evaporated fuel handling apparatus of a first embodiment of the present invention.

Descriptions will be hereinbelow provided for the embodiments of the present disclosure on the basis of the drawings. In the drawings used for the following descriptions, UP denotes upwards, and FR denotes frontwards. The following descriptions will be given by using these directions as reference directions for the sake of explanatory convenience.

FIG. 1 schematically shows a configuration of an evaporated fuel handling apparatus 1 of a first embodiment which is applied to a fuel tank of a motorcycle. This evaporated fuel handling apparatus 1 includes: a fuel tank 2; a fuel cap 4 openably and closably attached to a fuel filler port 3 of the fuel tank 2; a charge pipe 5 connected to the fuel cap 4 by penetrating the fuel tank 2; an evaporated fuel reservoir 6 connected to the charge pipe 5 outside the fuel tank 2; and a purge pipe 8 making the evaporated fuel reservoir 6 and an air intake system 7 communicate with each other. The evaporated fuel reservoir 6 is provided with a drain pipe 6A configured to inhale the air.

Figure 2:
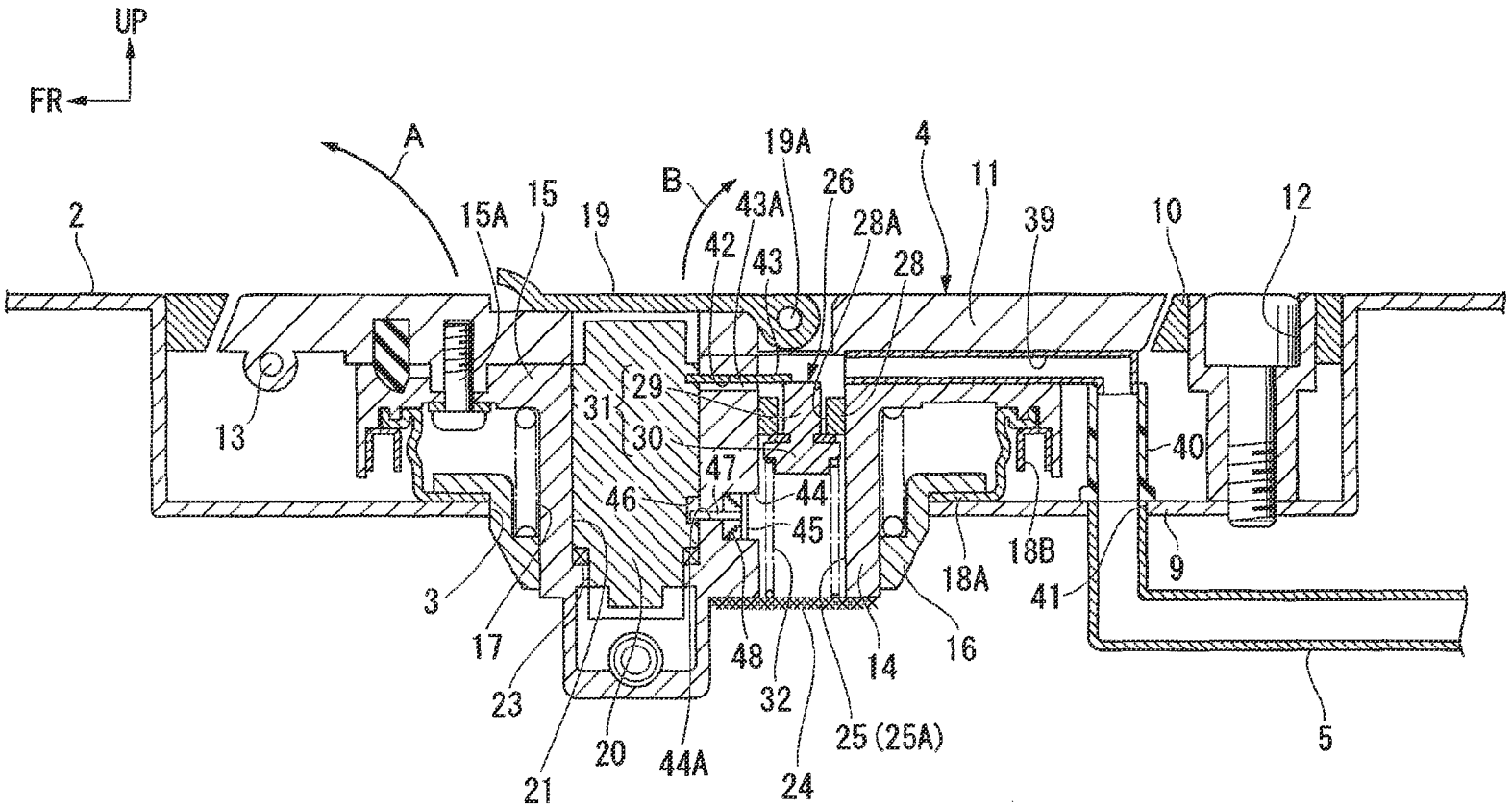
FIG. 2 is a cross-sectional view of a fuel cap of the evaporated fuel handling apparatus of the first embodiment.

As shown in FIG. 2, a seat portion 9 is formed in the fuel tank 2. The seat portion 9 is bent and accordingly recessed from the upper outer wall of the fuel tank 2, and is shaped like a recess in the cross-sectional view. The fuel filler port 3 is shaped like a circle in the plan view (the top view), and is formed in the almost center portion of the seat portion 9. The charge pipe 5 communicates with the inside of the fuel tank 2 via the fuel cap 4, and sends evaporated fuel, which occurs inside the fuel tank 2, to the evaporated fuel reservoir 6. The evaporated fuel reservoir 6 has adsorbent in its inside, and reserves the evaporated fuel, which has been sent to the evaporated fuel reservoir 6 through the charge pipe 5, with the adsorbent adsorbing the evaporated fuel.

The fuel cap 4 includes: an outer frame portion 10 fixed to the seat portion 9, and shaped like a circle; and a cap main body 11 placed inside the outer frame portion 10. Multiple counterbores 12 are made in the outer frame portion 10. The fuel cap 4 is fixed to the seat portion 9 with bolts inserted in the counterbores 12 of the outer frame portion 10. The cap main body 11 is connected to the outer frame portion 10 by use of a hinge 13, and is made openable and closable in a direction indicated with a turning arrow A in the drawing.

A body cap 14 shaped like a cylinder is provided to the undersurface of the cap main body 11, and integrally has a flange portion 15 in its upper-end edge. The body cap 14 is fixed to the undersurface of the cap main body 11 by use of multiple screws 15A penetrating through the flange portion 15. A seal member 18A made of resin material is fitted to the body cap 14 with the seal member 18A in press contact with the inner peripheral surface of the fuel filler port 3. In addition, a guide cap 16 is fitted to the body cap 14 in the inner periphery of the seal member 18A. The guide cap 16 is biased downwards by a spring 17 whose one end is in contact with the inner periphery of the flange portion 15 of the body cap 14.

The position of the guide cap 16 is restricted by making a bent portion of the guide cap 16, which is obtained by bending the upper end portion of the guide cap 16 in the outer peripheral direction, in contact with the seal member 18A which hangs down from the outer periphery of the flange portion 15 of the body cap 14. Incidentally, reference numeral 18B in the drawing denotes a fixation member to which to fix the seal member 18A.

A key cover 19, which opens and closes in a direction indicated with a turning arrow B in the drawing, is connected to the upper portion of the cap main body 11 by use of a hinge 19A. The key cover 19 exposes a key cylinder 20, which is provided near the center of the fuel cap 4, to the outside. The key cylinder 20 is housed in a cylinder chamber 21 formed in the body cap 14. The key cylinder 20 makes its keyhole face upwards. The lower portion of the key cylinder 20 is in contact with a mount member 23 which is made of resin material and is provided in the cylinder chamber 21. The key cylinder 20 is designed to be capable of being pressed into the cylinder chamber 21 by an extent that the mount member 23 is compressed depending on how much deeply the inserted key is inserted.

The key cylinder 20 unlocks the lock of the cap main body 11 when the key cylinder 20 is displaced downwards and turned by the key which is inserted in the key cylinder 20. To put it specifically, the key cylinder 20 has a configuration in which: the key cylinder 20 is provided with a lock piece (slider) which is configured to advance and retreat in the radial direction of the key cylinder 20 in accordance with the turn of the key, although not illustrated; and when this lock piece is locked in a restraint portion which, although not illustrated, is provided to the fuel tank 2, the opening of the cap main body 11 is restricted.

A communication chamber 25 extending in parallel with the cylinder chamber 21 is formed at the side of the cylinder chamber 21 of the body cap 14. The lower end portion of this communication chamber 25 is open to the inside of the fuel tank 2, and is covered with, for example, a meshed filter member 24 through which evaporated fuel and fuel in liquid state can pass. In addition, the upper end portion of the communication chamber 25 is closed with the undersurface of the cap main body 11.

Figure 3:
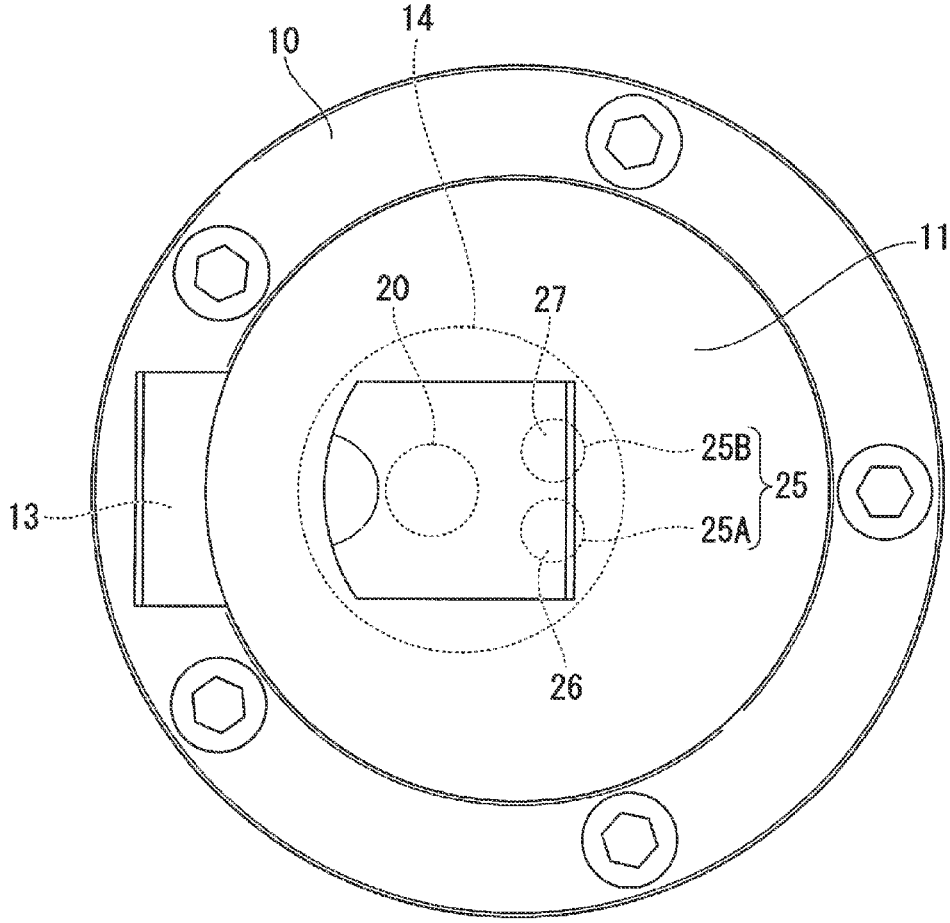
FIG. 3 is a top view of the fuel cap of the evaporated fuel handling apparatus of the first embodiment.

Referring to FIG. 3, the communication chamber 25 includes paired cylinder-shaped portions 25A, 25B which are formed by drilling them in the body cap 14 and adjacent to each other. The cylinder-shaped portion 25A is provided with a negative pressure control valve 26, and the cylinder-shaped portion 25B is provided with a positive pressure control valve 27. The negative pressure control valve 26 and the positive pressure control valve 27 divide the communication chamber 25 into its lower portion on the inner side of the fuel tank 2 and its upper portion on the outer side of the fuel tank 2. The negative pressure control valve 26 is biased by a predetermined biasing force from the inner side of the fuel tank 2, and opens once the internal pressure of the fuel tank 2 becomes equal to or less than a predetermined pressure. The positive pressure control valve 27 is biased by a predetermined biasing force from the outer side of the fuel tank 2, and opens once the internal pressure of the fuel tank 2 becomes equal to or greater than the predetermined pressure. In this respect, the negative pressure control valve 26 and the positive pressure control valve 27 are arranged on the other side of the key cylinder 20 from the hinge 13. Furthermore, the positive pressure control valve 27 and the negative pressure control valve 26 are arranged in parallel with each other around the key cylinder 20 in the circumferential direction of the key cylinder 20.

As shown in FIG. 2, the negative pressure control valve 26 includes: a valve seat 28 having a hole portion 28A, and formed to project from the inner peripheral surface of the cylinder-shaped portion 25A in the inner radial direction; a valve body 31 having a stem portion 29 which is fittingly inserted in the hole portion 28A of the valve seat 28, and a disc portion 30 which is connected to the lower end of the stem portion 29 and comes into contact with the valve seat 28 from the inner side of fuel tank 2; and a spring 32 configured to bias the valve body 31 with its one end in contact with the filter member 24, and with its opposite end in contact with the disc portion 30 of the valve body 31. The spring 32 is compressedly provided between the filter member 24 and the valve body 31, and thus gives a predetermined biasing force to the valve body 31.

Figure 4:
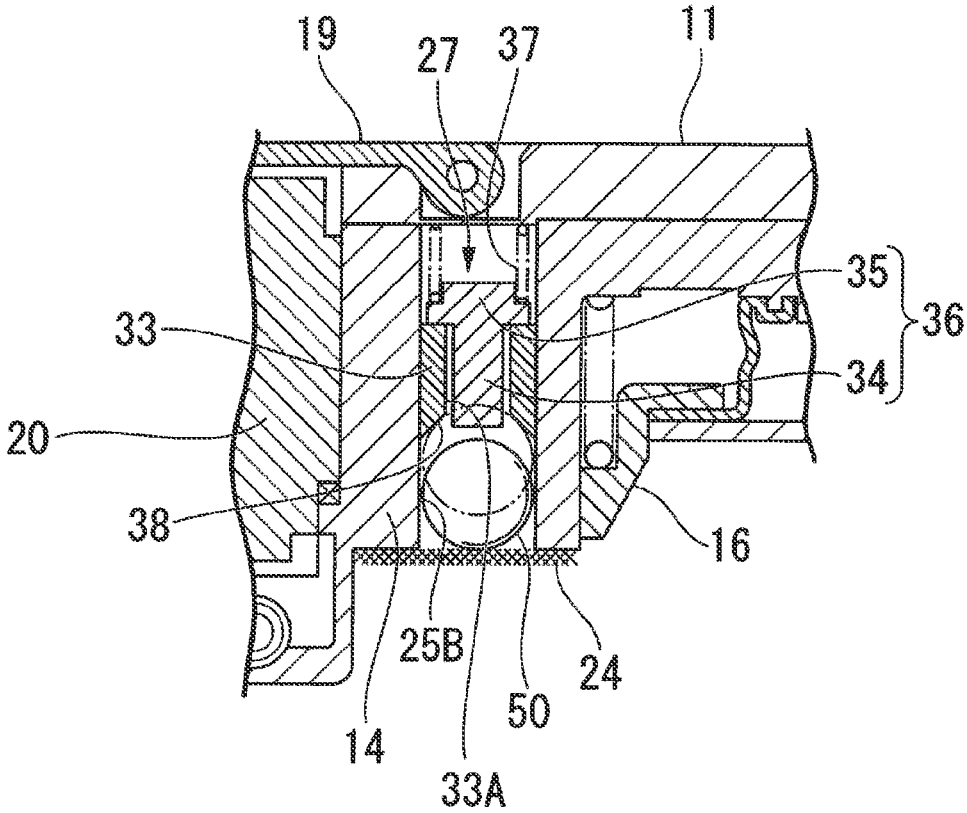
FIG. 4 is a cross-sectional view of a positive pressure control valve and its neighborhood provided to the fuel cap of the evaporated fuel handling apparatus of the first embodiment.

On the other hand, as shown in FIG. 4, the positive pressure control valve 27 includes: a valve seat 33 having a hole portion 33A, and formed to project from the inner peripheral surface of the cylinder-shaped portion 25B in the inner radial direction; a valve body 36 having a stem portion 34 which is inserted in the hole portion 33A of the valve seat 33, and a disc portion 35 which is connected to the upper end of the stem portion 34 and comes into contact with the valve seat 33 from the outer side of the fuel tank 2; and a spring 37 configured to bias the valve body 36 with its one end in contact with the undersurface of the cap main body 11, and with its opposite end in contact with the disc portion 35 of the valve body 36. As shown in FIG. 4, the stem portion 34 projects downwards from the valve seat 33 when the positive pressure control valve 27 is closed. The spring 37 is compressedly provided between the cap main body 11 and the valve body 36, and thus gives a predetermined biasing force to the valve body 36.

An inclined portion 38, which makes the inner diameter of the hole portion 33A increase (become larger) toward the bottom of the hole portion 33A, is integrally formed in the lower portion of the valve seat 33. A spherical rollover valve 50, which is floatingly movable between the valve seat 33 and the filter member 24, is housed under the seat valve 33 in the cylinder-shaped portion 25B. The diameter of the rollover valve 50 is set slightly smaller than the diameter of the cylinder-shaped portion 25B to an extent that evaporated fuel can pass between the rollover valve 50 and the cylinder-shaped portion 25B. The rollover valve 50 prevents the outflow of fuel by: being pushed by the fuel which enters the cylinder shaped portion 25B, too, when the fuel tank 2 tilts at an angle larger than a predetermined angle; thus pushing up the stem portion 29 of the positive pressure control valve 27; and accordingly closing the valve seat 33 (the inclined portion 38). In this respect, the contact of the rollover valve 50 into the inclined portion 38 enhances the tightness between the rollover valve 50 and the inclined portion 38.

Referring to FIG. 2, the upper end portions of the respective cylinder-shaped portions 25A, 25B are closed by the undersurface of the cap main body 11. Meanwhile, the upper spaces of the respective cylinder-shaped portions 25A, 25B, which are separated from the inner side of the fuel tank 2 by the negative pressure control valve 26 and the positive pressure control valve 27, communicate with each other. An intra-cap charge path 39 extending in the radial direction of the flange portion 15 is formed in an upper portion of the inner peripheral surface of the cylinder-shaped portion 25A. The intra-cap charge path 39 penetrates through the inside of the flange portion 15, and opens downwards in a space formed between the cap main body 11 and the seat portion 9.

A cylindrical elastic member 40, which is shaped like a cylinder, is hermetically connected to a downward-directed opening of the intra-cap charge path 39 while the fuel cap 4 is closed. The lower end portion of the cylindrical elastic member 40 is in intimate contact with the seat portion 9, and thus covers a communication opening 41 which is formed in the seat portion 9, while the cap main body 11 is in a closed state. The communication opening 41 is a hole which penetrates from the seat portion 9 to the inside of the fuel tank 2, and is hermetically connected to the charge pipe 5 which is placed inside the fuel tank 2. With this, the path from the inside of the fuel tank 2 to the evaporated fuel reservoir 6 is formed.

Furthermore, as shown in FIG. 2, the body cap 14 is provided with a through-hole 42, which makes the upper portion of the cylinder chamber 21 and the upper portion of the cylinder-shaped portion 25A communicate with each other. A pressure piece 43 is inserted in the through-hole 42. In addition, a diaphragm chamber 44, which makes the lower portion of the cylinder chamber 21 and the lower portion of the communication chamber 25 communicate with each other, is formed in the body cap 14.

The through-hole 42 is open to a portion of the cylinder-shaped portion 25A on the outer side of the fuel tank 2 formed as a result of being partitioned by the negative pressure control valve 26. The pressure piece 43 is placed with its one end fixed to the key cylinder 20, and with its opposite end facing the inside of the communication chamber 25 and thus being in contact with the upper end of the stem portion 29 of the valve body 31 of the negative pressure control valve 26. This pressure piece 43 is displaced downwards in conjunction with the downward movement of the key cylinder 20. Thereby, the pressure piece 43 presses the valve body 31 downwards, and sets the negative pressure control valve 26 open forcedly. Incidentally, the pressure piece 43 is made to penetrate through the through-hole 42, while a seal 43A for filling the gap between the through-hole 42 and the pressure piece 43 is provided to the through-hole 42.

On the other hand, the diaphragm chamber 44 is formed to be recessed toward the key cylinder 20 from a portion of the cylinder-shaped portion 25A on the inner side of the fuel tank 2 formed as a result of being partitioned by the negative pressure control valve 26. The diaphragm chamber 44 has a communication path 44A which penetrates to the cylinder chamber 21, and accordingly communicates with the cylinder chamber 21. A diaphragm 45 is provided inside the diaphragm chamber 44. The gaseous phase of a portion of the diaphragm chamber 44 which is closer to the cylinder chamber 21 is separated from the gaseous phase of the inside of the fuel tank 2 with the diaphragm 45 interposed in between.

An engagement groove 46, which is shaped like a recess, is formed in the outer peripheral surface of the key cylinder 20 inside the cylinder chamber 21, with the engagement groove 46 being on a line extended from the communication path 44A. An engagement pin 47 capable of engaging with the engagement groove 46 is connected to the diaphragm 45. A biasing member 48 is housed in an internal portion of the diaphragm chamber 44 which is closer to the communication path 44A, the biasing member 48 configured to bias the diaphragm 45 against the internal pressure of fuel tank 2 in a direction which is opposite to the direction in which the engagement pin 47 engages with the engagement groove 46. Thereby, when the internal pressure of the fuel tank 2 is high, the engagement pin 47 engages with the engagement groove 46 in conjunction with the compression of the biasing member 48 by the diaphragm 45, and accordingly restricts the turn of the key cylinder 20. Furthermore, when the internal pressure of the fuel tank 2 becomes equal to the pressure of the atmosphere, the diaphragm 45 is biased by the biasing member 48, and accordingly makes the engagement pin 47 disengage from the engagement groove 46. This allows the turn of the key cylinder 20.

When the internal pressure of the fuel tank 2 becomes equal to or less than the predetermined pressure and the negative pressure control valve 26 accordingly opens, the thus-configured evaporated fuel handling apparatus 1 becomes capable of sending the atmosphere from the evaporated fuel reservoir 6 to the fuel tank 2 via the charge pipe 5 because the fuel tank 2 and the charge pipe 5 are set to communicate with each other via the fuel cap 4. In addition, when the internal pressure of the fuel tank 2 becomes equal to or greater than the predetermined pressure, the evaporated fuel handling apparatus 1 becomes capable of sending the evaporated fuel, which occurs inside the fuel tank 2, to the evaporated fuel reservoir 6 via the charge pipe 5 because the positive pressure control valve 27 opens and the fuel tank 2 and the charge pipe 5 are set to communicate with each other via the fuel cap 4.

Figure 5:
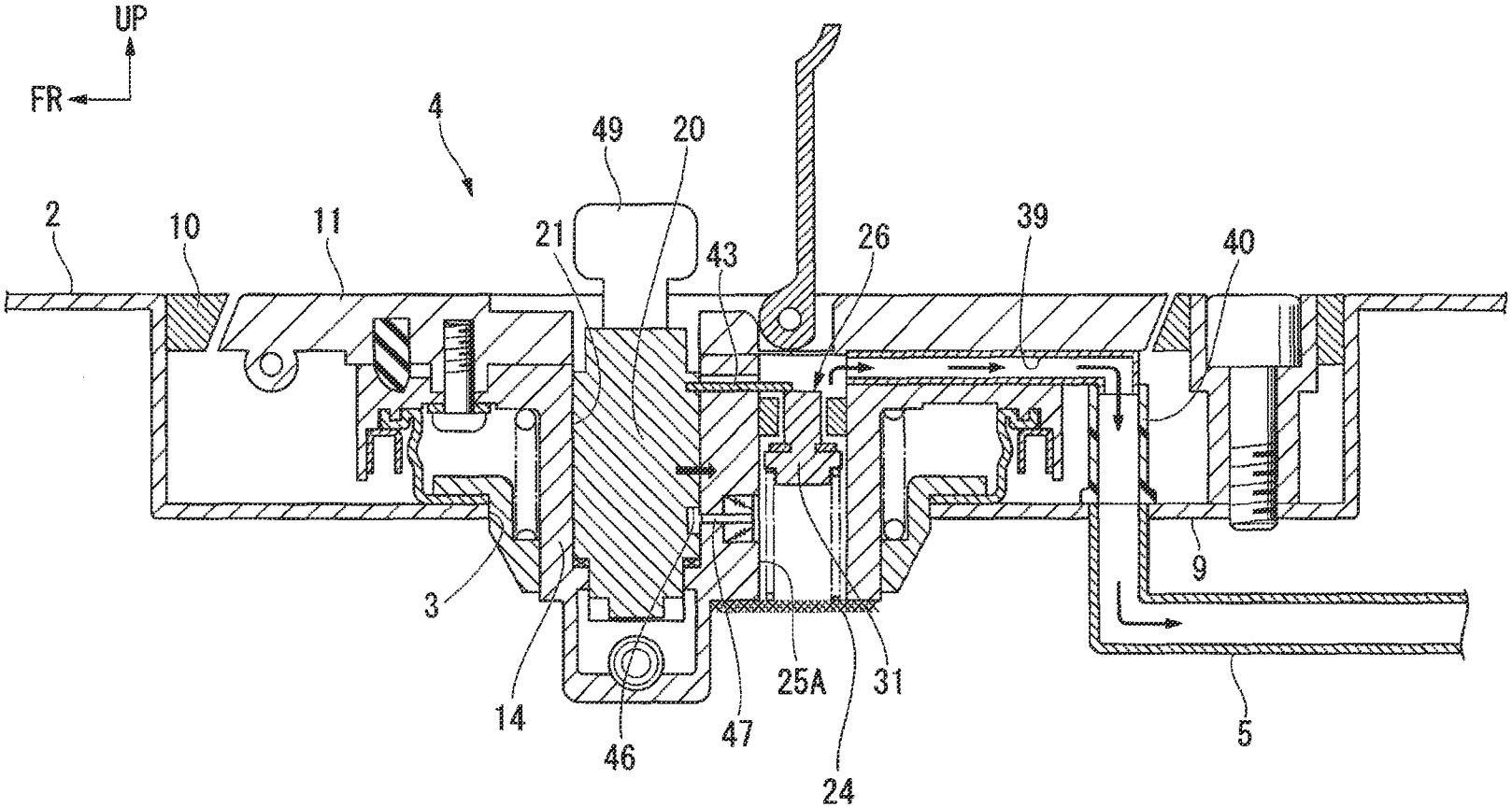
FIG. 5 is a diagram for explaining how to operate the evaporated fuel handling apparatus of the first embodiment.

Moreover, referring to FIG. 5, when the key cylinder 20 is pressed down by the key 49 inserted in the key cylinder 20, the pressure piece 43 presses down the valve body 31 of the negative pressure control valve 26, and the negative pressure control valve 26 is accordingly opened. Once the negative pressure control valve 26 is opened in this manner, the internal pressures in the fuel tank 2 is bled to the evaporated fuel reservoir 6 via the cylinder-shaped portion 25A, the intra-cap charge path 39, the cylindrical elastic member 40 and the charge pipe 5, as indicated with the arrows in the drawing. Thereafter, once the internal pressure of the fuel tank 2 becomes lower, the engagement pin 47 moves in a direction indicated with an arrow in the drawing, and thus disengages from the engagement groove 46. This allows the turn of the key cylinder 20, and makes it possible to open the fuel cap 4.

As described above, the evaporated fuel handling apparatus 1 of the embodiment is capable of preventing the evaporated fuel from being discharged into the atmosphere due to the internal pressure of the fuel tank 2 when the fuel cap 4 is opened, because before the fuel cap 4 is opened, the evaporated fuel handling apparatus 1 is capable of bleeding the internal pressure of the fuel tank 2 to the evaporated fuel reservoir 6 by setting the negative pressure control valve 26 open in conjunction with the action of inserting the key 49 into the key cylinder 20 when the fuel cap 4 is opened. In addition, during times such as while the vehicle is running, the evaporated fuel handling apparatus 1 is capable of reducing the amount of evaporated fuel to be sent to the evaporated fuel reservoir 6, because the evaporated fuel handling apparatus 1 is capable of keeping the fuel tank 2 in the hermetic state by use of the positive pressure control valve 27 and the negative pressure control valve 26 until the internal pressure of the fuel tank 2 reaches the predetermined pressure.

Next, descriptions will be provided for a second embodiment of the present invention. Components which are the same as those of the first embodiment will be denoted with the same reference numerals, and descriptions for such components will be omitted.

Figure 6:
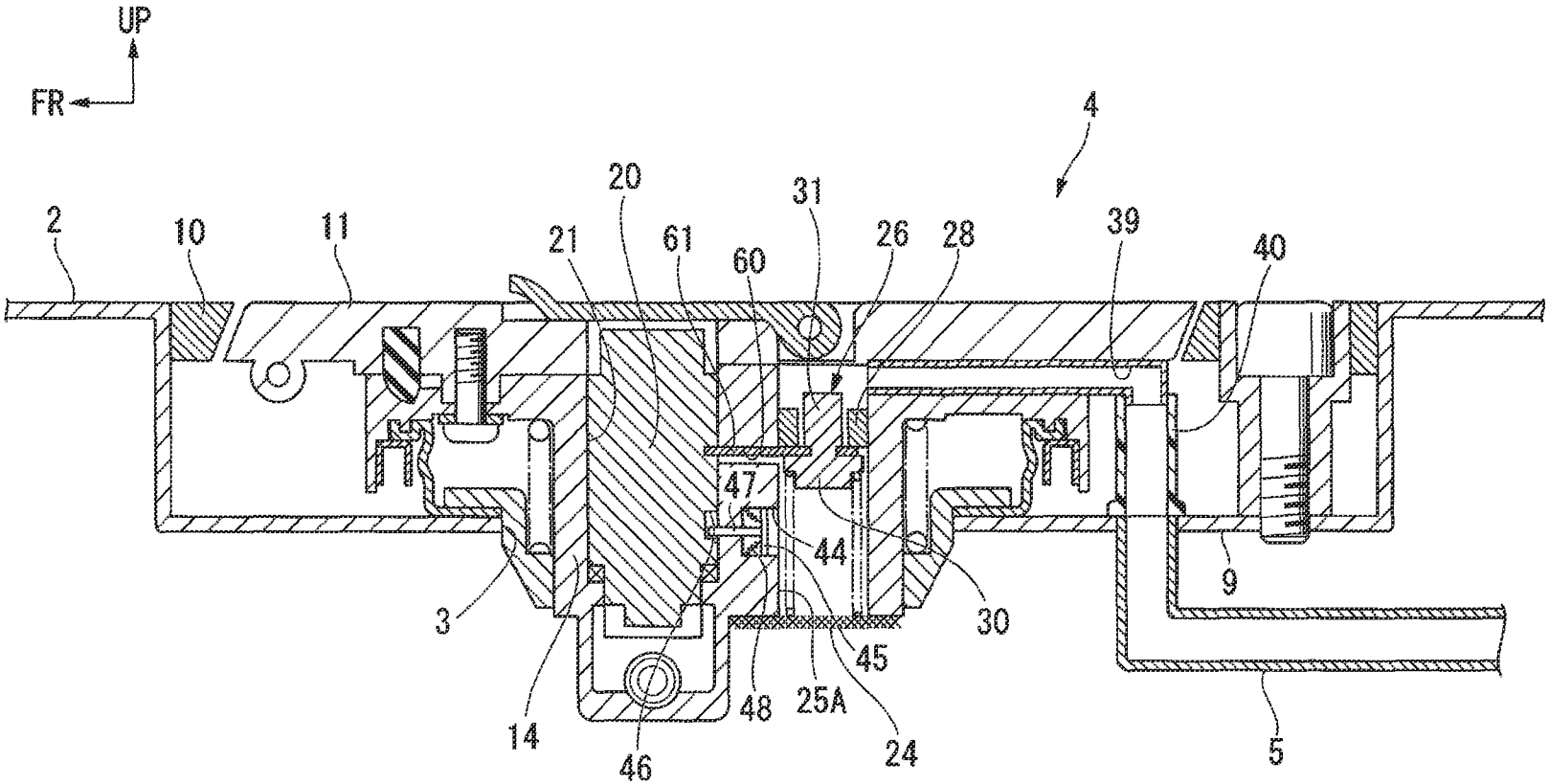
FIG. 6 is a cross-sectional view of a fuel cap of an evaporated fuel handling apparatus of a second embodiment of the present invention.

As shown in FIG. 6, in this embodiment, a through-hole 60 is provided between a cylinder chamber 21 and a cylinder-shaped portion 25A in a body cap 14. The through-hole 60 is open to a portion of the cylinder-shaped portion 25A on the inner side of a fuel tank 2 formed as a result of being partitioned by a negative pressure control valve 26 (a valve seat 28). A pressure piece 61 inserted in the through-hole 60 is in contact with the disc portion 30 of the valve body 31 from above with its first end fixed to the key cylinder 20, and with its second end facing the inside of the cylinder-shaped portion 25A. The second end of the pressure piece 61 is interposed between the valve seat 28 and the disc part 30 of the valve body 31. This state makes the hermetic quality kept. The pressure piece 61 is displaced downwards in conjunction with the downward movement of the key cylinder 20. This configuration of the embodiment makes it possible to reduce the axial length of the cylinder chamber 21 of the body cap 14.

Next, descriptions will be provided for a third embodiment of the present invention. This embodiment is different from the first embodiment in terms of the configuration of the diaphragm 45. Components which are the same as those of the first embodiment will be denoted with the same reference numerals, and descriptions for such components will be omitted.

Figure 7:
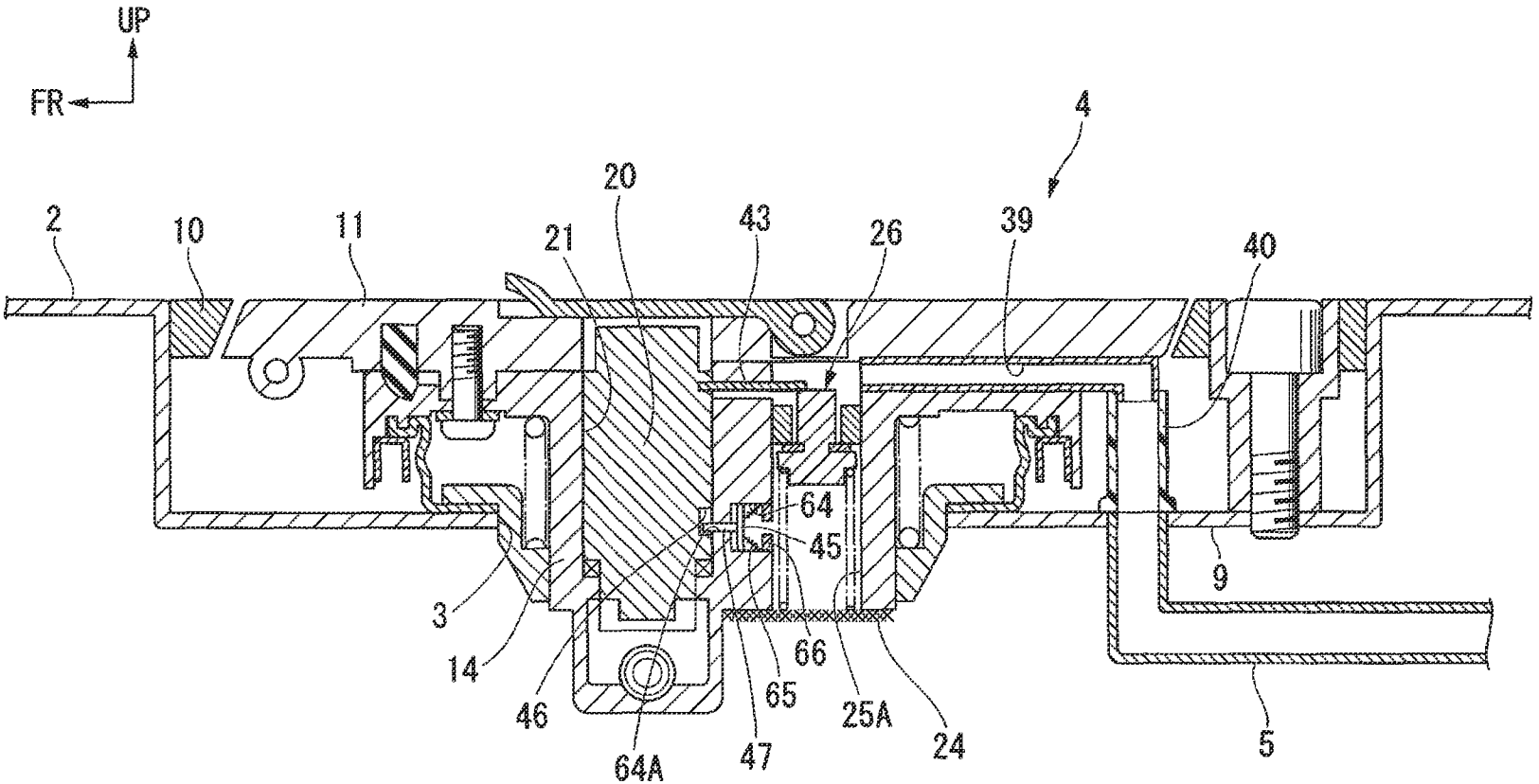
FIG. 7 is a cross-sectional view of a fuel cap of an evaporated fuel handling apparatus of a third embodiment of the present invention.

As shown in FIG. 7, in this embodiment, a diaphragm chamber 64 striding between the key cylinder 20 and the cylinder-shaped portion 25A is formed in the body cap 14, like in the first embodiment. The diaphragm chamber 64 is formed to be recessed toward the key cylinder 20 from a portion of the cylinder-shaped portion 25A which is on the outer side of the fuel tank 2 formed as a result of being partitioned by the negative pressure control valve 26. The diaphragm chamber 64 has a communication path 64A which penetrates to the cylinder chamber 21, and accordingly communicates with the cylinder chamber 21. A biasing member 65 is provided on an internal portion of the diaphragm chamber 64 which is closer to the fuel tank 2, the biasing member 65 configured to bias the diaphragm 45 against the air pressure of the communication path 44A in the direction in which the engagement pin 47 engages with the engagement groove 46. A part of the biasing member 65 is supported by a projecting piece 66 which is formed in an edge portion of the diaphragm chamber 64 which is closer to the fuel tank 2.

In the configuration of the embodiment, when the internal pressure of the fuel tank 2 is high, the diaphragm 45 receives the internal pressure of the tank, and is concurrently biased by the biasing member 65. Thereby, the engagement pin 47 engages with the engagement groove 46, and accordingly restricts the turn of the key cylinder 20. Thereafter, when the internal pressure of the fuel tank 2 decreases and becomes less than the air pressure of the communication path 44A, the diaphragm 45 is displaced against the biasing force of the biasing member 65, and thus makes the engagement pin 47 disengage from the engagement groove 46. This allows the turn of the key cylinder 20.

Figure 8:
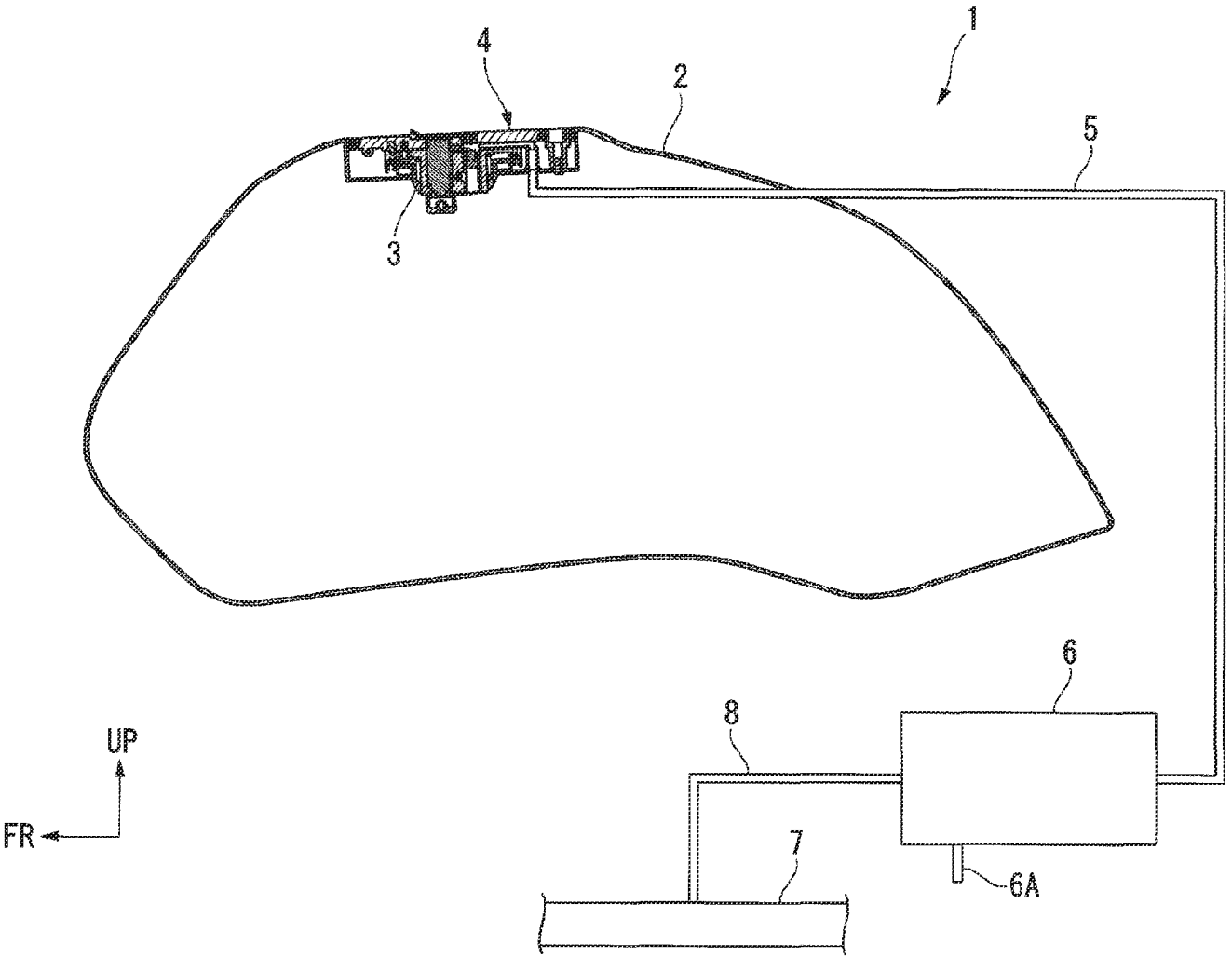
FIG. 8 is a diagram schematically showing an evaporated fuel handling apparatus of a fourth embodiment of the present invention.

Next, FIG. 8 schematically shows a configuration of an evaporated fuel handling apparatus of a fourth embodiment which is applied to the fuel tank of the motorcycle. This evaporated fuel handling apparatus 1 includes: a fuel tank 2; a fuel cap 4 openably and closably attached to a fuel filler port 3 of the fuel tank 2; a charge pipe 5 connected to the fuel cap 4 by penetrating the fuel tank 2; an evaporated fuel reservoir 6 connected to the charge pipe 5 outside the fuel tank 2; and a purge pipe 8 making the evaporated fuel reservoir 6 and an air intake system 7 communicating with each other. The evaporated fuel reservoir 6 is provided with a drain pipe 6A configured to inhale the air. Note that Components which are the same as those of the above embodiment will be denoted with the same reference numerals.

Figure 9:
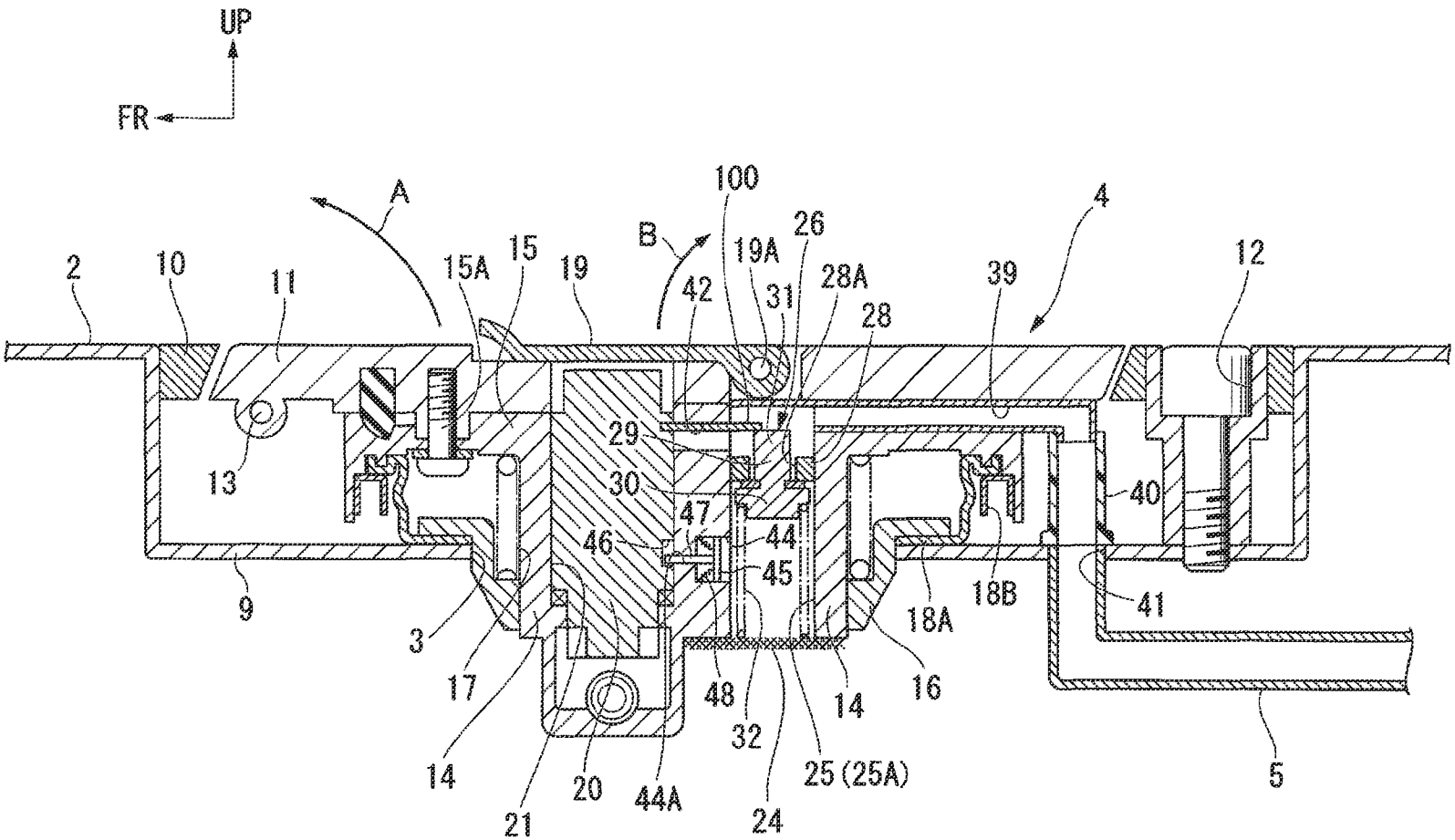
FIG. 9 is a cross-sectional view of a fuel cap of the evaporated fuel handling apparatus of the fourth embodiment.

As shown in FIG. 9, a seat portion 9 is formed in the fuel tank 2. The seat portion 9 is bent and accordingly recessed from the upper outer wall of the fuel tank 2, and is shaped like a recess in the cross-sectional view. The fuel filler port 3 is shaped like a circle in the plan view (the top view), and is formed in the almost center portion of the seat portion 9. The charge pipe 5 communicates with the inside of the fuel tank 2 via the fuel cap 4, and sends evaporated fuel, which occurs in the inside of the fuel tank 2, to the evaporated fuel reservoir 6. The evaporated fuel reservoir 6 has adsorbent in its inside, and reserves the evaporated fuel, which has been sent to the evaporated fuel reservoir 6 through the charge pipe 5, with the adsorbent adsorbing the evaporated fuel.

The fuel cap 4 includes: an outer frame portion 10 fixed to the seat portion 9, and shaped like a circle; and a cap main body 11 placed inside the outer frame portion 10. Multiple counterbores 12 are made in the outer frame portion 10. The fuel cap 4 is fixed to the seat portion 9 with bolts inserted in the counterbores 12 of the outer frame portion 10. The cap main body 11 is connected to the outer frame portion 10 by use of a hinge 13, and is made openable and closable in a direction indicated with a turning arrow A in the drawing.

A body cap 14 shaped like a cylinder is provided to the undersurface of the cap main body 11, and integrally has a flange portion 15 in its upper-end edge. The body cap 14 is fixed to the undersurface of the cap main body 11 by use of multiple screws 15A penetrating through the flange portion 15. A seal member 18A made of resin material is fitted to the body cap 14 with the seal member 18A in press contact with the inner peripheral surface of the fuel filler port 3. In addition, a guide cap 16 is fitted to the body cap 14 in the inner periphery of the seal member 18A. The guide cap 16 is biased downwards by a spring 17 whose one end is in contact with the inner periphery of the flange portion 15 of the body cap 14.

The position of the guide cap 16 is restricted by making a bent portion of the guide cap 16, which is obtained by bending the upper end portion of the guide cap 16 in the outer peripheral direction, in contact with the seal member 18A which hangs down from the outer periphery of the flange portion 15 of the body cap 14. Incidentally, reference numeral 18B in the drawing denotes a fixation member to which to fix the seal member 18A.

A key cover 19, which opens and closes in a direction indicated with a turning arrow B in the drawing, is connected to the upper portion of the cap main body 11 by use of a hinge 19A. The key cover 19 exposes a key cylinder 20 to the outside. The key cylinder 20 is housed in a cylinder chamber 21 formed in the body cap 14. The key cylinder 20 makes its keyhole face upwards.

The key cylinder 20 unlocks the lock of the cap main body 11 when the key cylinder 20 is turned by a key 49 which is inserted in the key cylinder 20. To put it specifically, the key cylinder 20 has a configuration in which: the key cylinder 20 is provided with a lock piece (slider) which is configured to advance and retreat in the radial direction of the key cylinder 20 in accordance with the turn of the key, although not illustrated; and when this lock piece is locked in a restraint portion which, although not illustrated, is provided to the fuel tank 2, the opening of the cap main body 11 is restricted.

A communication chamber 25 extending in parallel with the cylinder chamber 21 is formed at the side of the cylinder chamber 21 of the body cap 14. The lower end portion of this communication chamber 25 is open to the inside of the fuel tank 2, and is covered with, for example, a meshed filter member 24 through which evaporated fuel and fuel in liquid state can pass. In addition, the upper end portion of the communication chamber 25 is closed with the undersurface of the cap main body 11.

Figure 10:
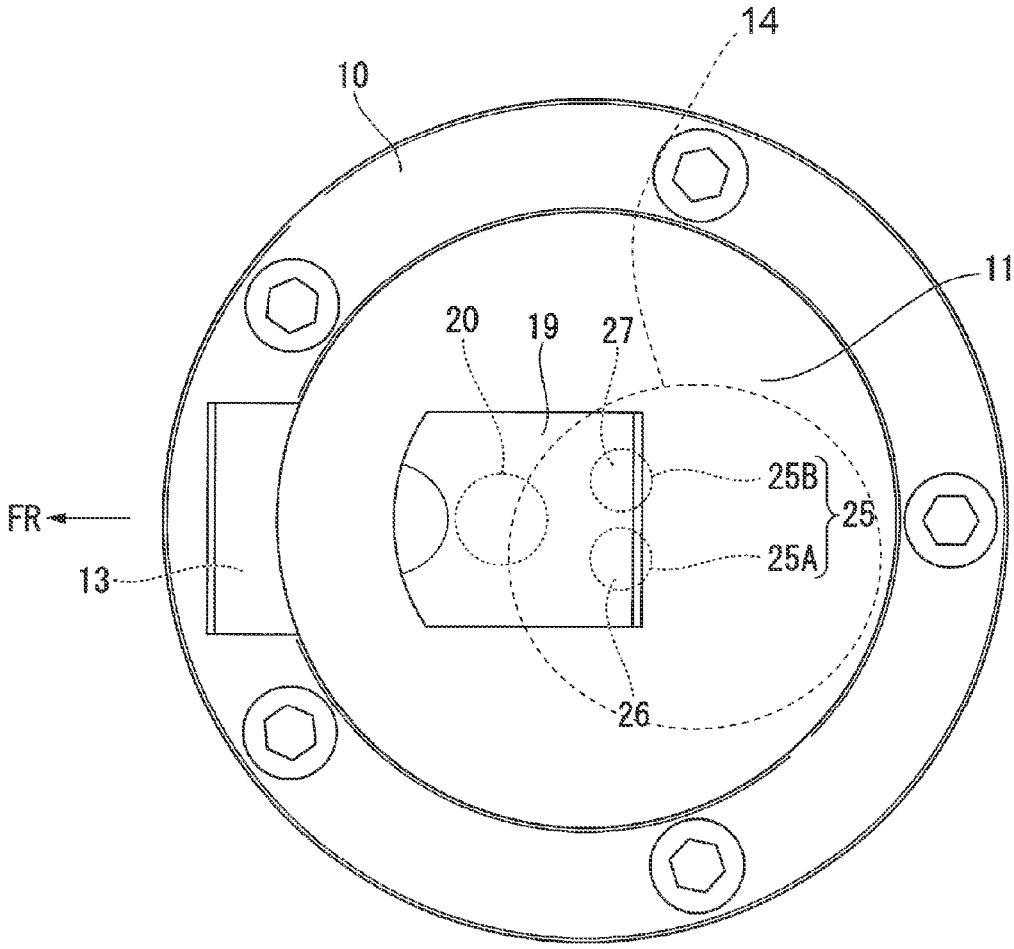
FIG. 10 is a top view of the fuel cap of the evaporated fuel handling apparatus of the fourth embodiment.

Referring to FIG. 10, the communication chamber 25 includes paired cylinder-shaped portions 25A, 25B which are formed by drilling them in the body cap 14 and adjacent to each other. The cylinder-shaped portion 25A is provided with a negative pressure control valve 26, and the cylinder-shaped portion 25B is provided with a positive pressure control valve 27. The negative pressure control valve 26 and the positive pressure control valve 27 divide the communication chamber 25 into its lower portion on the inner side of the fuel tank 2 and its upper portion on the outer side of the fuel tank 2. The negative pressure control valve 26 is biased by a predetermined biasing force from the inner side of the fuel tank 2, and opens once the internal pressure of the fuel tank 2 becomes equal to or less than a predetermined pressure. The positive pressure control valve 27 is biased by a predetermined biasing force from the outer side of the fuel tank 2, and opens once the internal pressure of the fuel tank 2 becomes equal to or greater than the predetermined pressure. In this respect, the negative pressure control valve 26 and the positive pressure control valve 27 are arranged on the other side of the key cylinder 20 from the hinge 13.

As shown in FIG. 9, the negative pressure control valve 26 includes: a valve seat 28 having a hole portion 28A, and formed to project from the inner peripheral surface of the cylinder-shaped portion 25A in the inner radial direction; a valve body 31 having a stem portion 29 which is fittingly inserted in the hole portion 28A of the valve seat 28, and a disc portion 30 which is connected to the lower end of the stem portion 29 and comes into contact with the valve seat 28 from the inner side of fuel tank 2; and a spring 32 configured to bias the valve body 31 with its one end being in contact with the filter member 24, and with its opposite end being in contact with the disc portion 30 of the valve body 31. The spring 32 is compressedly provided between the filter member 24 and the valve body 31, and thus gives a predetermined biasing force to the valve body 31.

Figure 11:
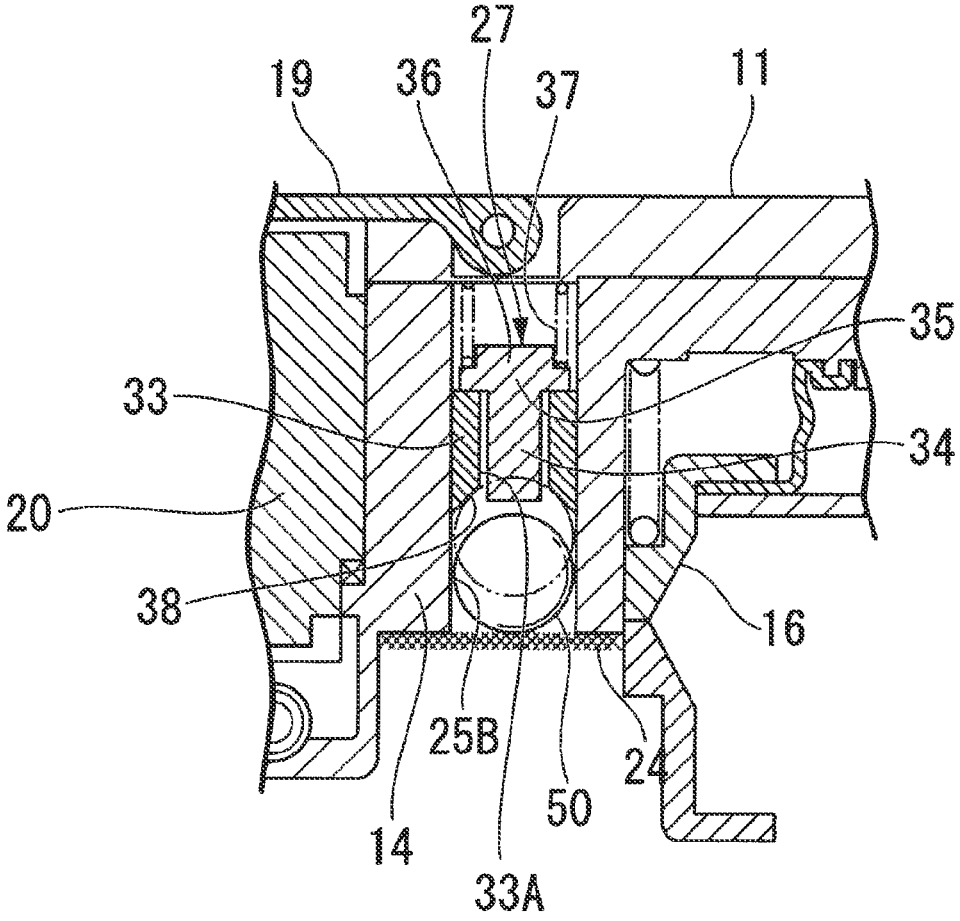
FIG. 11 is a cross-sectional view of a positive pressure control valve and its neighborhood provided to the fuel cap of the evaporated fuel handling apparatus of the fourth embodiment.

On the other hand, as shown in FIG. 11, the positive pressure control valve 27 includes: a valve seat 33 having a hole portion 33A, and formed to project from the inner peripheral surface of the cylinder-shaped portion 25B in the inner radial direction; a valve body 36 having a stem portion 34 which is inserted in the hole portion 33A of the valve seat 33, and a disc portion 35 which is connected to the upper end of the stem portion 34 and comes into contact with the valve seat 33 from the outer side of the fuel tank 2; and a spring 37 configured to bias the valve body 36 with its one end being in contact with the undersurface of the cap main body 11, and with its opposite end being in contact with the disc portion 35 of the valve body 36. As shown in FIG. 11, the stem portion 34 projects downwards from the valve seat 33 when the positive pressure control valve 27 is closed. The spring 37 is compressedly provided between the cap main body 11 and the valve body 36, and thus gives a predetermined biasing force to the valve body 36.

An inclined portion 38, which makes the inner diameter of the hole portion 33A increase (become larger) toward the bottom of the hole portion 33A, is integrally formed in the lower portion of the valve seat 33. A spherical rollover valve 50, which is floatingly movable between the valve seat 33 and the filter member 24, is housed under the seat valve 33 in the cylinder-shaped portion 25B. The diameter of the rollover valve 50 is set slightly smaller than the diameter of the cylinder-shaped portion 25B to an extent that evaporated fuel can pass between the rollover valve 50 and the cylinder-shaped portion 25B. The rollover valve 50 prevents the outflow of fuel by: being pushed by the fuel which enters the cylinder shaped portion 25B, too, when the fuel tank 2 tilts at an angle larger than a predetermined angle; thus pushing up the stem portion 34 of the positive pressure control valve 27; and accordingly closing the valve seat 33 (the inclined portion 38). In this respect, the contact of the rollover valve 50 into the inclined portion 38 enhances the tightness between the rollover valve 50 and the inclined portion 38.

Referring to FIG. 9, the upper end portions of the respective cylinder-shaped portions 25A, 25B are closed by the undersurface of the cap main body 11. Meanwhile, the upper spaces of the respective cylinder-shaped portions 25A, 25B, which are separated from the inner side of the fuel tank 2 by the negative pressure control valve 26 and the positive pressure control valve 27, communicate with each other. An intra-cap charge path 39 extending in the radial direction of the flange portion 15 is formed in an upper portion of the inner peripheral surface of the cylinder-shaped portion 25A. The intra-cap charge path 39 penetrates through the inside of the flange portion 15, and opens downwards in a space formed between the cap main body 11 and the seat portion 9.

A cylindrical elastic member 40, which is shaped like a cylinder, is hermetically connected to a downward-directed opening of the intra-cap charge path 39 while the fuel cap 4 is closed. The lower end portion of the cylindrical elastic member 40 is in intimate contact with the seat portion 9, and thus covers a communication opening 41 which is formed in the seat portion 9, while the cap main body 11 is in a closed state. The communication opening 41 is a hole which penetrates from the seat portion 9 to the inside of the fuel tank 2, and is hermetically connected to the charge pipe 5 which is placed in the inside the fuel tank 2. With this, the path from the inside of the fuel tank 2 to the evaporated fuel reservoir 6 is formed.

Furthermore, as shown in FIG. 9, the body cap 14 is provided with a through-hole 42, which makes the upper portion of the cylinder chamber 21 and the upper portion of the cylinder-shaped portion 25A communicate with each other. A linkage member 100 is inserted in the through-hole 42. In addition, a diaphragm chamber 44, which makes the lower portion of the cylinder chamber 21 and the lower portion of the communication chamber 25 communicate with each other, is formed in the body cap 14.

The through-hole 42 is open to a portion of the cylinder-shaped portion 25A on the outer side of the fuel tank 2 formed as a result of being partitioned by the negative pressure control valve 26. The linkage member 100 is placed with its first end engaging with the key cylinder 20, and with its second end facing the inside of the communication chamber 25 and thus being in contact with the upper end of the stem portion 29 of the valve body 31 of the negative pressure control valve 26.

This linkage member 100 is displaced downwards in conjunction with the manipulation of turning the key cylinder 20. Thereby, the linkage member 100 presses the valve body 31 downwards, and sets the negative pressure control valve 26 open forcedly.

Figure 12A:
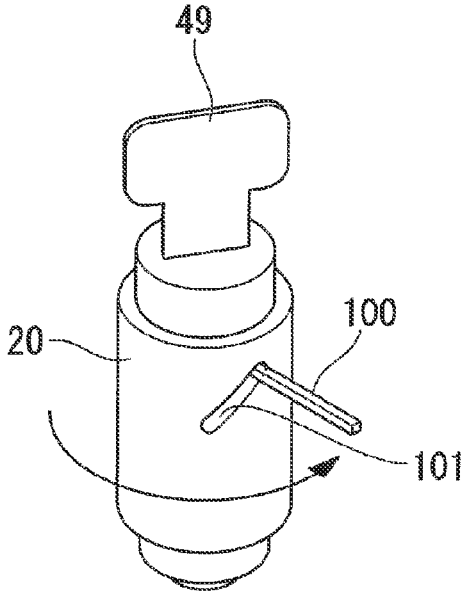
FIGS. 12A and 12B are perspective views of a key cylinder and a pressure piece in the fuel cap of the fourth embodiment.
Figure 12B:
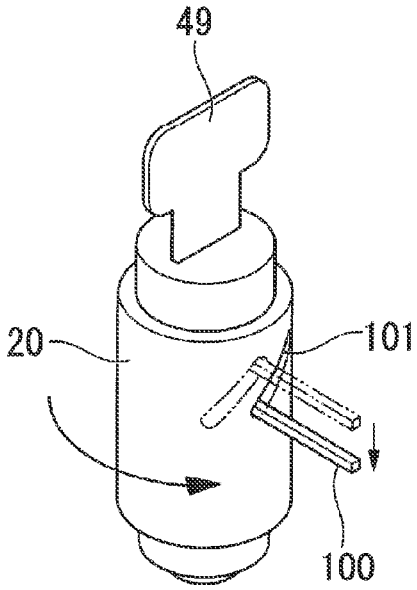

FIGS. 12A and 12B show structures of the key cylinder 20 and the linkage member 100. A groove 101 (a helical engagement groove) extending diagonally to the circumferential direction of the key cylinder 20 is formed in the key cylinder 20. The first end of the linkage member 100 engages with the groove 101. When, as shown in FIG. 12A, the key 49 is inserted into the key cylinder 20 and the key cylinder 20 is turned in the turning arrow in the drawing, the linkage member 100 is displaced downwards along the groove 101, as shown in FIG. 12B. Thereby, the valve body 31 is pressed down.

On the other hand, the diaphragm chamber 44 is formed to be recessed toward the key cylinder 20 from a portion of the cylinder-shaped portion 25A on the inner side of the fuel tank 2 formed as a result of being partitioned by the negative pressure control valve 26. The diaphragm chamber 44 has a communication path 44A which penetrates to the cylinder chamber 21, and accordingly communicates with the cylinder chamber 21. A diaphragm 45 is provided inside the diaphragm chamber 44. The gaseous phase of a portion of the diaphragm chamber 44 which is closer to the cylinder chamber 21 is separated from the gaseous phase of the inside of the fuel tank 2 with the diaphragm 45 interposed in between.

An engagement groove 46, which is shaped like a recess, is formed in the outer peripheral surface of the key cylinder 20 inside the cylinder chamber 21, with the engagement groove 46 being on a line extended from the communication path 44A. An engagement pin 47 capable of engaging with the engagement groove 46 is connected to the diaphragm 45. A biasing member 48 is housed in an internal portion of the diaphragm chamber 44 which is closer to the communication path 44A, the biasing member 48 configured to bias the diaphragm 45 against the internal pressure of fuel tank 2 in a direction which is opposite to the direction in which the engagement pin 47 engages with the engagement groove 46. Thereby, when the internal pressure of the fuel tank 2 is high, the engagement pin 47 engages with the engagement groove 46 in conjunction with the compression of the biasing member 48 by the diaphragm 45, and accordingly restricts the turn of the key cylinder 20. Furthermore, when the internal pressure of the fuel tank 2 becomes equal to the pressure of the atmosphere, the diaphragm 45 is biased by the biasing member 48, and accordingly makes the engagement pin 47 disengage from the engagement groove 46. This allows the turn of the key cylinder 20.

When the internal pressure of the fuel tank 2 becomes equal to or less than the predetermined pressure and the negative pressure control valve 26 accordingly opens, the thus-configured evaporated fuel handling apparatus 1 becomes capable of sending air from the evaporated fuel reservoir 6 to the fuel tank 2 via the charge pipe 5 because the fuel tank 2 and the charge pipe 5 are set to communicate with each other via the fuel cap 4. In addition, when the internal pressure of the fuel tank 2 becomes equal to or greater than the predetermined pressure, the evaporated fuel handling apparatus 1 becomes capable of sending the evaporated fuel, which occurs in the inside of the fuel tank 2, to the evaporated fuel reservoir 6 via the charge pipe 5 because: the positive pressure control valve 27 opens; and the fuel tank 2 and the charge pipe 5 are accordingly set to communicate with each other via the fuel cap 4.

Figure 13:
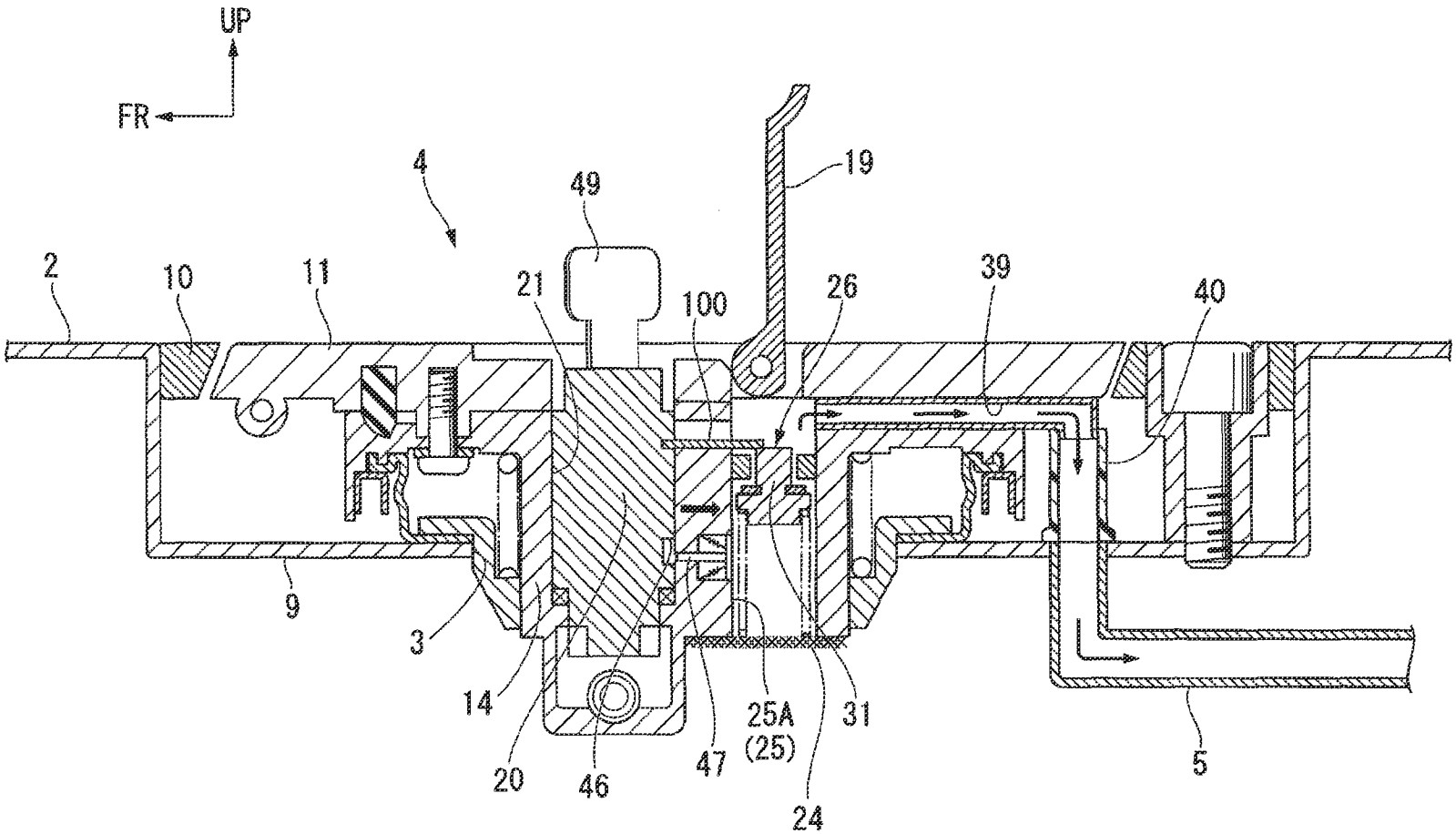
FIG. 13 is a diagram for explaining how to operate the evaporated fuel handling apparatus of the fourth embodiment.

Moreover, referring to FIG. 13, when the linkage member 100 is pressed down by turning the key 49 inserted in the key cylinder 20, the linkage member 100 presses down the valve body 31 of the negative pressure control valve 26, and the negative pressure control valve 26 is accordingly opened. Once the negative pressure control valve 26 is opened in this manner, the internal pressures in the fuel tank 2 is bled to the evaporated fuel reservoir 6 via the cylinder-shaped portion 25A, the intra-cap charge path 39, the cylindrical elastic member 40 and the charge pipe 5, as indicated with the arrows in the drawing. Thereafter, once the internal pressure of the fuel tank 2 becomes lower, the engagement pin 47 moves in a direction indicated with an arrow in the drawing, and thus disengages from the engagement groove 46. This allows the turn of the key cylinder 20, and makes it possible to open the fuel cap 4.

As described above, the evaporated fuel handling apparatus 1 of the embodiment is capable of preventing the evaporated fuel from being discharged into the atmosphere due to the internal pressure of the fuel tank 2 when the fuel cap 4 is opened, because before the fuel cap 4 is opened, the evaporated fuel handling apparatus 1 is capable of bleeding the internal pressure of the fuel tank 2 to the evaporated fuel reservoir 6 by setting the negative pressure control valve 26 open in conjunction with the action of turning the key cylinder 20 by use of the key 49 when the fuel cap 4 is opened. In addition, the evaporated fuel handling apparatus 1 exhibits excellent convenience, and can be suitably applied to small vehicles, because the prevention of the discharge of the evaporated fuel into the atmosphere can be achieved by the simple structure employing the action of turning the key cylinder 20 by use of the key 49. Furthermore, during times such as while the vehicle is running, the evaporated fuel handling apparatus 1 is capable of reducing the amount of evaporated fuel to be sent to the evaporated fuel reservoir 6, because the evaporated fuel handling apparatus 1 is capable of keeping the fuel tank 2 in the hermetic state by use of the positive pressure control valve 27 and the negative pressure control valve 26 until the internal pressure of the fuel tank 2 reaches the predetermined pressure.

Next, descriptions will be provided for a fifth embodiment of the present invention. This embodiment is what is obtained by adding changes to the fourth embodiment. Components which are the same as those of the fourth embodiment will be denoted with the same reference numerals, and descriptions for such components will be omitted.

Figure 14:
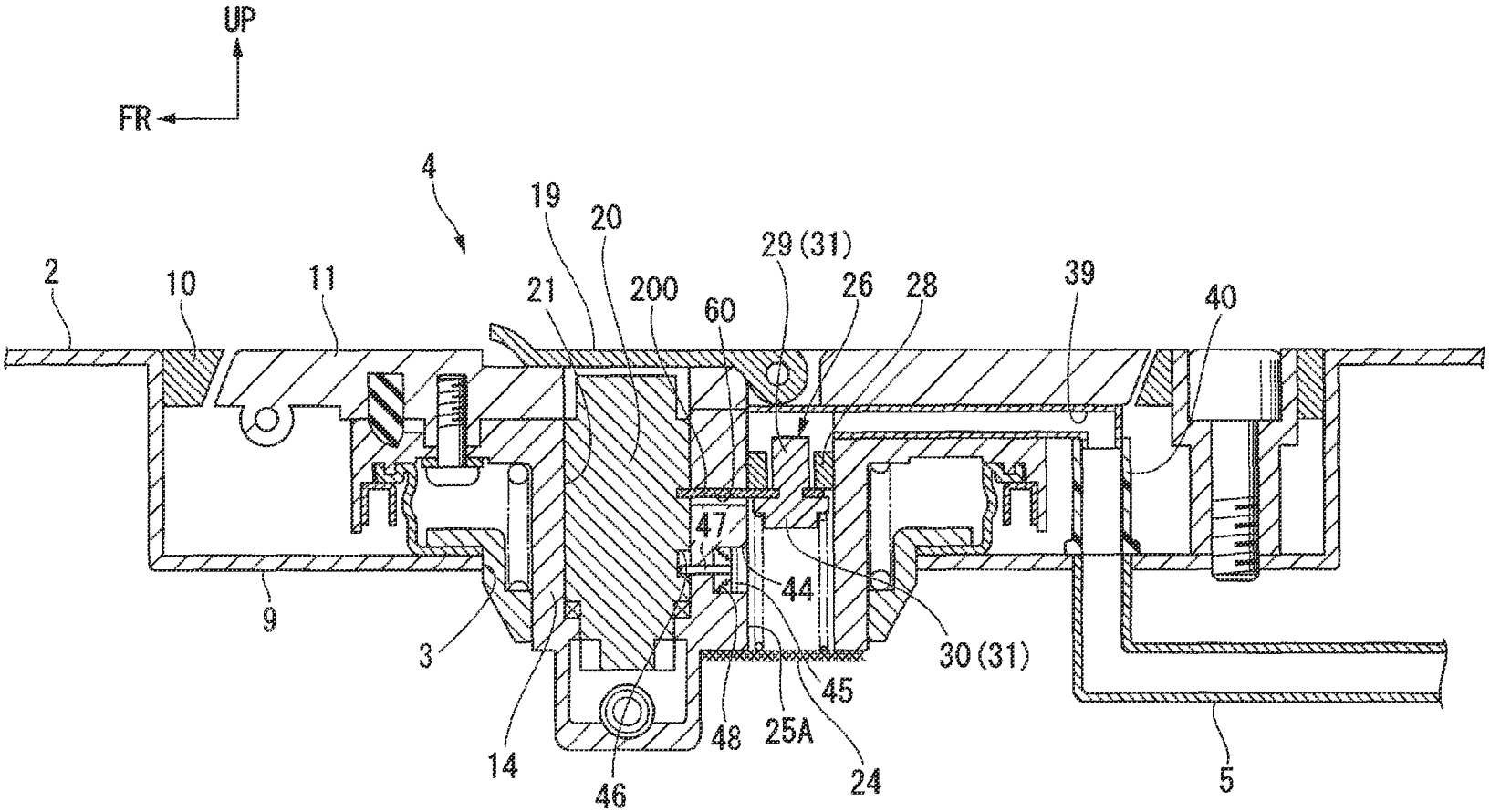
FIG. 14 is a cross-sectional view of a fuel cap of an evaporated fuel handling apparatus of a fifth embodiment of the present invention.

As shown in FIG. 14, in this embodiment, a through-hole 60 is provided between a cylinder chamber 21 and a cylinder-shaped portion 25A in a body cap 14. The through-hole 60 is open to a portion of the cylinder-shaped portion 25A on the inner side of a fuel tank 2 formed as a result of being partitioned by a negative pressure control valve 26 (a valve seat 28). A linkage member 200 inserted in the through-hole 60 is in contact with a disc portion 30 of a valve body 31 from above with its first end engaging with a key cylinder 20, and with its second end facing the inside of the cylinder-shaped portion 25A. The second end of the linkage member 200 is interposed between the valve seat 28 and the disc part 30 of the valve body 31. This state makes the hermetic quality kept. A groove extending diagonally is formed in the key cylinder 20. The linkage member 200 is displaced downwards along this groove in conjunction with the turn of the key cylinder 20. This configuration of the embodiment makes it possible to reduce the axial length of the cylinder chamber 21 of the body cap 14.

Next, descriptions will be provided for a 6th embodiment of the present invention. This embodiment is different from the fourth embodiment in terms of the configuration of a diaphragm 45. Components which are the same as those of the first embodiment will be denoted with the same reference numerals, and descriptions for such components will be omitted.

Figure 15:
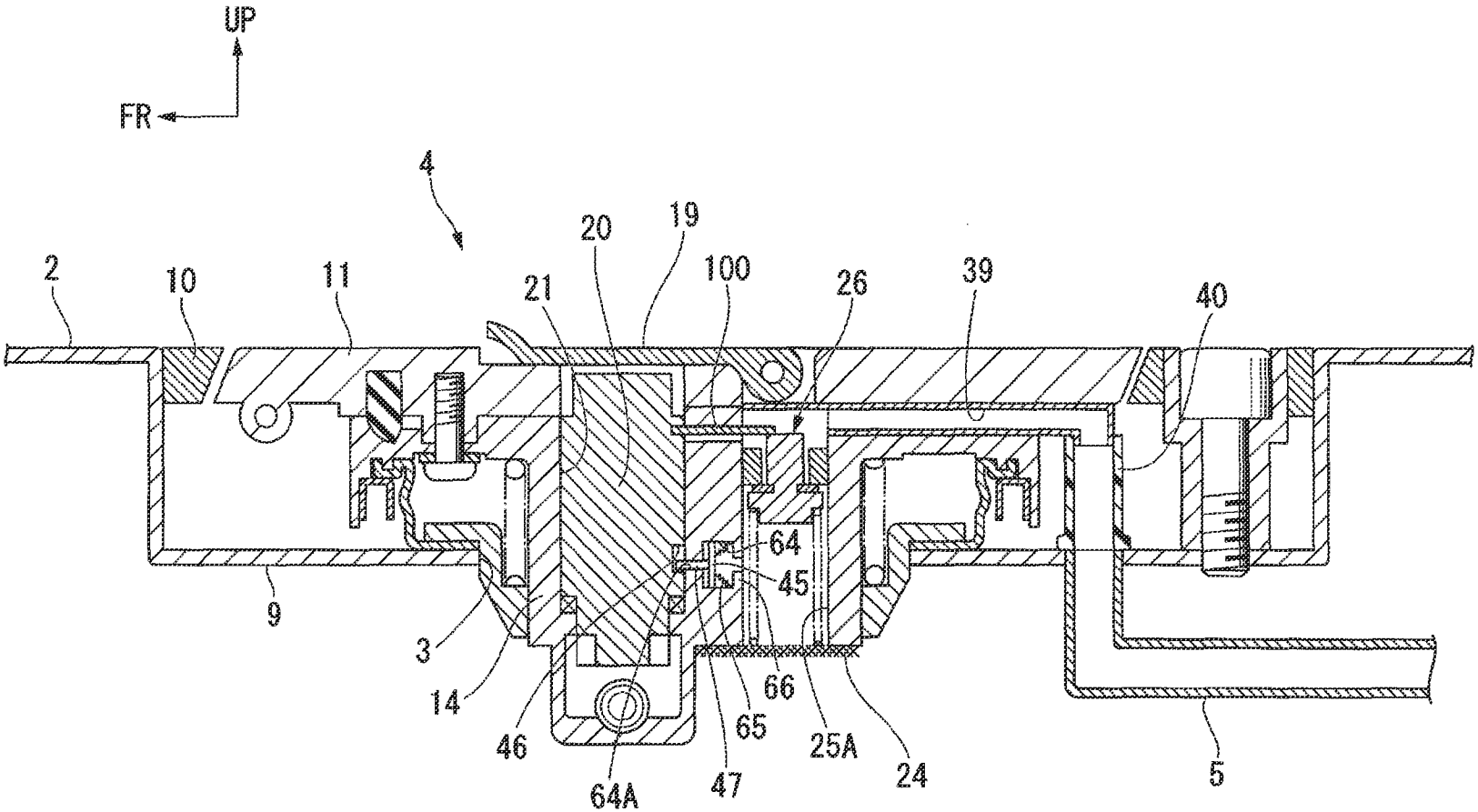
FIG. 15 is a cross-sectional view of a fuel cap of an evaporated fuel handling apparatus of a 6th embodiment of the present invention.
Figure 16:
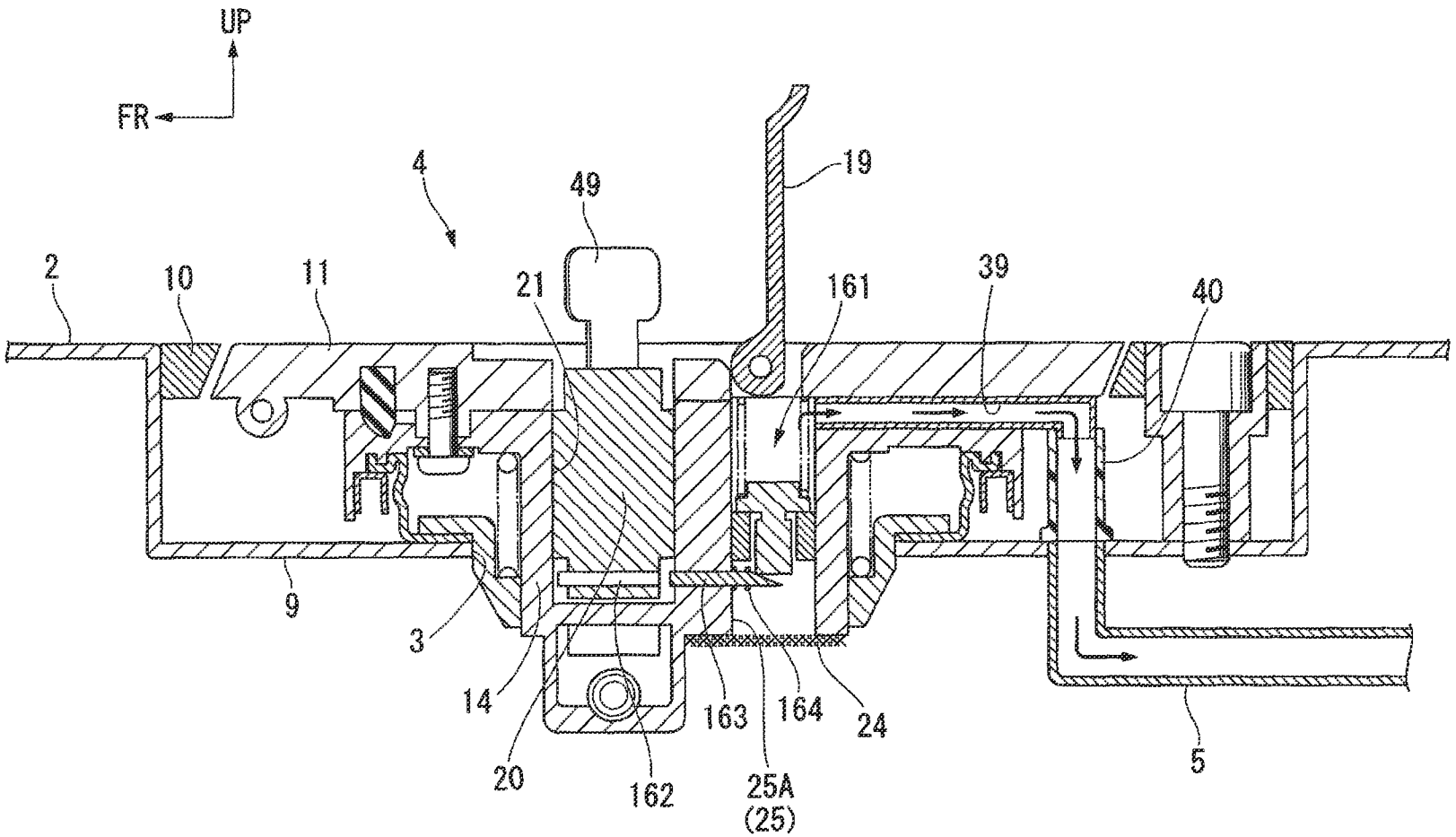
FIG. 16 is a cross-sectional view of a fuel cap of an evaporated fuel handling apparatus of a 7th embodiment of the present invention.

As shown in FIG. 15, in this embodiment, a diaphragm chamber 64 striding between a key cylinder 20 and a cylinder-shaped portion 25A is formed in a body cap 14, like in the fourth embodiment. The diaphragm chamber 64 is formed to be recessed toward the key cylinder 20 from a portion of the cylinder-shaped portion 25A on the inner side of a fuel tank 2 formed as a result of being partitioned by the negative pressure control valve 26. The diaphragm chamber 64 has a communication path 64A which penetrates to a cylinder chamber 21, and accordingly communicates with the cylinder chamber 21. A biasing member 65 is provided on an internal portion of the diaphragm chamber 64 which is closer to the fuel tank 2, the biasing member 65 to bias the diaphragm 45 against the air pressure of the communication path 64A in the direction in which an engagement pin 47 engages with an engagement groove 46. An end of the biasing member 65 is supported by a projecting piece 66 which is formed in an edge portion of the diaphragm chamber 64 which is closer to the fuel tank 2.

In the configuration of the embodiment, when the internal pressure of the fuel tank 2 is high, the diaphragm 45 receives the internal pressure of the tank, and is concurrently biased by the biasing member 65. Thereby, the engagement pin 47 engages with the engagement groove 46, and accordingly restricts the turn of the key cylinder 20. Thereafter, when the internal pressure of the fuel tank 2 decreases and becomes less than the air pressure of the communication path 64A, the diaphragm 45 is displaced against the biasing force of the biasing member 65, and thus makes the engagement pin 47 disengage from the engagement groove 46. This allows the turn of the key cylinder 20.

Next, descriptions will be provided for a 7th embodiment of the present invention. Components which are the same as those of the first embodiment will be denoted with the same reference numerals, and descriptions for such components will be omitted.

In this embodiment, a positive pressure control valve 161 is provided to a cylinder-shaped portion 25A of a communication path 25 formed in a body cap 14. The positive pressure control valve 161 is biased downwards by a spring. A negative pressure control valve 26 is provided to a cylinder-shaped portion 25B, which is not illustrated.

A through-hole is formed between a cylinder chamber 21 and a portion of the cylinder-shaped portion 25A of the communication path 25 on the inner side of a fuel tank 2, with the positive pressure control valve 161 housed in the cylinder-shaped portion 25A. A linkage member 163 is slidably provided in this through-hole. The linkage member 163 makes its first end faces the inside of the cylinder chamber 21, and an inclined surface, which is formed in its second end, in contact with the lower end of the stem portion of the positive pressure control valve 161.

A cam 162 turnable in the circumferential direction of a key cylinder 20, which is situated on a line extended from the first end of the linkage member 163, is provided in a lower portion of the key cylinder 20. This cam 162 makes its high-level portion come into contact with the linkage member 163 in conjunction with the turn of the key cylinder 20, and accordingly slides the linkage member 163 toward the cylinder-shaped portion 25A.

The configuration of this embodiment makes it possible to send the internal pressure of the fuel tank 2 to an evaporated fuel reservoir 6 by sliding the linkage member 163 by the manipulation of turning the key cylinder 20; pushing up the positive pressure control valve 161 by use of the inclined surface of the linkage member 163; and thus setting the positive pressure control valve 161 open. Incidentally, the linkage member 163 is held, by a spring denoted by reference numeral 164, at a predetermined position where the linkage member 163 places its end portion, which is closer to the cylinder chamber 21, on the rotational track of the high-level portion of the cam 162, while the linkage member 163 is separated from the cam 162. In addition, although the foregoing descriptions have been provided for the configuration in which the positive pressure control valve 161 is pushed up by the linkage member 163 and the cam 162 in conjunction with the turn of the key cylinder 20, this embodiment may instead employ a configuration in which the negative pressure control valve 26 is pushed up by changing the placement of the linkage member 163 and the placement of the cam 162.

Although the foregoing descriptions have been provided for the first to 7th embodiments of the present invention, the present disclosure is not limited to the foregoing embodiments. For example, as for the first to third embodiments, even a configuration in which the pressure piece is displaced by its contact with the key 49 inserted in the key cylinder 20 may be employed, although the foregoing descriptions have been provided for the configuration in which the key cylinder 20 is pressed down in conjunction with the manipulation of inserting the key 49 and the pressure piece (43, 61) are thus displaced. In addition, as for the first to third embodiment of the present invention, even a configuration in which the positive pressure control valve 27 is set open in conjunction with the manipulation of the key cylinder 20 offers the same effects as does the present invention, although the foregoing descriptions have been provided for the configuration in which the internal pressure of the fuel tank 2 is bled by setting the negative pressure control valve 26 open. Furthermore, as for the fourth to 6th embodiment, even a configuration in which the positive pressure control valve 27 is set open in conjunction with the manipulation of the key cylinder 20 offers the same effects as does the present invention, although the foregoing descriptions have been provided for the configuration in which the internal pressure of the fuel tank 2 is bled by setting the negative pressure control valve 26 open. Moreover, although the fourth to 6th embodiments have the configuration in which: the key cylinder 20 is provided with the lock piece (not illustrated) configured to advance and retreat in the radial direction of the key cylinder 20 in accordance with the turn of the key; and the opening of the cap main body 11 is restricted by locking this lock piece in the restraint portion (not illustrated) provided to the fuel tank 2, the fourth to 6th embodiments may instead have a configuration in which the negative control valve 26 is pressed down utilizing the advancing and retreating movement of the lock piece.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. An evaporated fuel handling apparatus for a vehicle, comprising:

a fuel tank to reserve fuel;

a fuel cap attached to a fuel filler port of the fuel tank configured to open and close the fuel filler port by manipulation with a key inserted in a key cylinder;

an evaporated fuel reservoir to reserve evaporated fuel with adsorbent adsorbing the evaporated fuel;

a charge path facilitating communication between the fuel tank and the evaporated fuel reservoir; and a purge path facilitating communication between the evaporated fuel reservoir and an air intake system of an internal combustion engine, wherein the fuel cap comprises a communication chamber which facilitates communication between the charge path and an inside of the fuel tank, the communication chamber comprises an on-off valve configured to open when an internal pressure of the fuel tank becomes equal to a predetermined pressure, thus facilitating communication between the fuel tank and the evaporated fuel reservoir, and the on-off valve is set open by a linkage member linked to the manipulation of the key, and thus sends the evaporated fuel in the fuel tank to the evaporated fuel reservoir.

2. The evaporated fuel handling apparatus for a vehicle according to claim 1, wherein a pressure piece is provided between the key cylinder and the on-off valve, the pressure piece constituting the linkage member which is configured to open the on-off valve in conjunction with an action of inserting the key into the key cylinder and pressing down the key cylinder.

3. The evaporated fuel handling apparatus for a vehicle according to claim 2, wherein the on-off valve comprises:

a positive pressure control valve configured to open, and send the evaporated fuel, which is inside the fuel tank, to the evaporated fuel reservoir via the communication chamber and the charge path, when the internal pressure of the fuel tank becomes equal to or greater than a predetermined pressure; and a negative pressure control valve configured to open, and send air from the evaporated fuel reservoir to the fuel tank via the communication chamber and the charge path, when the internal pressure of the fuel tank becomes equal to or less than the predetermined pressure, and the pressure piece is provided to link with any one of the positive pressure control valve and the negative pressure control valve.

4. The evaporated fuel handling apparatus for a vehicle according to claim 3, wherein the key cylinder is provided in a cylinder chamber which is provided at or near a center of the fuel cap, the positive pressure control valve and the negative pressure control valve are arranged in parallel in a circumferential direction about the key cylinder, outside the key cylinder in the fuel cap in a radial direction, wherein a through-hole is formed between the cylinder chamber and the communication chamber housing the negative pressure control valve, and the pressure piece penetrates through the through-hole, and connects the key cylinder and the negative pressure control valve by a sealing member.

5. The evaporated fuel handling apparatus for a vehicle according to claim 4, wherein a key manipulation waiting mechanism is provided inside the communication chamber comprising the positive pressure control valve or the negative pressure control valve, wherein the key manipulation waiting mechanism is configured to detect a difference between pressures inside and outside the fuel tank, and to prohibit manipulation of the key when the internal pressure of the fuel tank is equal to or greater than a predetermined pressure.

6. The evaporated fuel handling apparatus for a vehicle according to claim 1, wherein the key cylinder is provided with the linkage member configured to open the on-off valve in conjunction with a manipulation of turning the key.

7. The evaporated fuel handling apparatus for a vehicle according to claim 6, wherein the on-off valve comprises:

a positive pressure control valve configured to open, and send the evaporated fuel, which occurs inside the fuel tank to the evaporated fuel reservoir via the communication chamber and the charge path, when the internal pressure of the fuel tank becomes equal to or greater than the predetermined pressure; and a negative pressure control valve configured to open, and send air from the evaporated fuel reservoir to the fuel tank via the communication chamber and the charge path, when the internal pressure of the fuel tank becomes equal to or less than the predetermined pressure, the key cylinder is provided in a cylinder chamber which is provided in or near the center of the fuel cap, the positive pressure control valve and the negative pressure control valve are arranged in parallel in a circumferential direction about the key cylinder, outside the key cylinder in the fuel cap in a radial direction, a through-hole is formed between the cylinder chamber and the communication chamber housing any one of the positive pressure control valve and the negative pressure control valve, and a helical engagement groove is formed in a side surface of the key cylinder, the linkage member is engaged at one end with the engagement groove, penetrates through the through-hole, and is connected at an opposite end to the positive pressure control valve or the negative pressure control valve, and the positive pressure control valve or the negative pressure control valve is set open in conjunction with upward and downward movement of the linkage member, which is caused by a turning of the key cylinder.

8. The evaporated fuel handling apparatus for a vehicle according to claim 6, wherein the on-off valve comprises:

a positive pressure control valve configured to open, and send the evaporated fuel, which is inside the fuel tank, to the evaporated fuel reservoir via the communication chamber and the charge path, when the internal pressure of the fuel tank becomes equal to or greater than the predetermined pressure; and a negative pressure control valve configured to open, and send air from the evaporated fuel reservoir to the fuel tank via the communication chamber and the charge path when the internal pressure of the fuel tank becomes equal to or less than the predetermined pressure, the key cylinder is provided in a cylinder chamber which is provided at or near the center of the fuel cap, the positive pressure control valve and the negative pressure control valve are arranged in parallel in a circumferential direction about the key cylinder, outside the key cylinder in the fuel cap in a radial direction, a through-hole is formed between the cylinder chamber and the communication chamber housing the positive pressure control valve or the negative pressure control valve, and the linkage member is slidably provided in the through-hole; a cam, which turns in a circumferential direction of the key cylinder, is formed in the key cylinder; and the positive pressure control valve or the negative pressure control valve is set open when the linkage member comes into contact with the cam and thus slides in conjunction with turn of the key cylinder.

* * * * *